United States Patent [19]

Lindsay

[11] 4,009,047

[45] Feb. 22, 1977

[54] METHOD AND DEVICE FOR CLEANING SHEETS

[75] Inventor: Thomas W. Lindsay, St. Anthony Village, Minn.

[73] Assignee: Minnesota Mining and Manufacturing Company, St. Paul, Minn.

[22] Filed: Nov. 19, 1974

[21] Appl. No.: 525,098

Related U.S. Application Data

[63] Continuation-in-part of Ser. No. 421,326, Dec. 3, 1973, Pat. No. 3,914,817.

[52] U.S. Cl. ..... 134/9; 15/1.5 R; 15/3; 15/100; 15/256.52; 29/132; 352/130

[51] Int. Cl.[2] ..... B08B 6/00; B08B 11/00; G03D 15/00

[58] Field of Search ..... 15/100, 102, 104 A, 15/256.51, 256.52, 256.53, 3; 101/425; 134/9; 355/15; 352/130

[56] References Cited

UNITED STATES PATENTS

| | | | |
|---|---|---|---|
| 1,401,012 | 12/1921 | Teitel | 15/100 |
| 3,682,690 | 8/1972 | Amos et al. | 15/104 A UX |
| 3,792,925 | 2/1974 | Milligan et al. | 15/256.52 |
| 3,837,952 | 9/1974 | Mogford | 15/104 A |
| 3,861,860 | 1/1975 | Thettu | 15/256.52 X |
| 3,883,921 | 5/1975 | Thettu | 15/104 A X |

FOREIGN PATENTS OR APPLICATIONS

| | | | |
|---|---|---|---|
| 1,077,960 | 3/1960 | Germany | 15/104 A |

*Primary Examiner*—Daniel Blum
*Attorney, Agent, or Firm*—Alexander, Sell, Steldt & DeLaHunt

[57] ABSTRACT

A device for cleaning foreign material from at least one surface of a sheet including at least one low durometer sheet cleaning roller having a tacky peripheral surface. The surface of the sheet to be cleaned is biased against and moved generally tangentially across the tacky peripheral surface of the cleaning roller with rolling contact therebetween so that foreign material on the surface of the sheet will be adhered to the tacky surface of the cleaning roller. The tacky surface of the cleaning roller is in turn cleaned by bringing into rolling contact therewith a surface on a roller cleaning member (which surface may be provided by the adhesive on a length of tape) having a higher surface tack than the cleaning roller. In one embodiment of the device the roller cleaning member is periodically passed over the cleaning roller by the operator of the device, whereas other embodiments automatically pass the roller cleaning member over the cleaning roller during each cycle of the device to clean a sheet.

17 Claims, 21 Drawing Figures

METHOD AND DEVICE FOR CLEANING SHEETS

CROSS REFERENCE TO RELATED APPLICATION

This application is a continuation-in-part of an application Ser. No. 421,326 filed Dec. 3, 1973, now U.S. Pat. No. 3,914,817 issued Oct. 28, 1975, the disclosure whereof is incorporated herein by reference.

BACKGROUND OF THE INVENTION

1. Field of the Invention

This invention relates to a method for cleaning sheet materials such as photographic films or the wafers used in integrated circuit production, and to various embodiments of a device for practicing the method.

2. Description of the Prior Art

Thorough removal of dust particles from sheets is often necessary for proper utilization of the sheet. For example, thorough removal of dust particles from photographic film such as a negative or a lantern slide is necessary to produce high quality prints, particularly when an enlarged print is to be made. Also, dust particles must be thoroughly removed from the surfaces of metal oxide semi-conductor wafers on which integrated circuits are to be formed, or the dust may cause imperfections in the circuits.

The prior art is replete with sheet cleaning devices. Illustrative examples include those described in U.S. Pat. Nos. 1,162,812, 1,389,082, 1,401,012, 3,128,492, 3,149,356, 3,453,681, 3,641,605, 3,644,953, and German Auslegeschrift No. 1,077,960. These devices can, with varying degrees of effectiveness, remove foreign particles from sheets such as photographic film. The cleaning methods performed by these devices, however, have had certain limitations or presented certain problems which restrict their efficiency or adaptability for the cleaning of certain types of sheets.

For example, the devices suggested in most of the aforementioned U.S. patents wipe or brush the surface of the sheet. Such cleaning action presents the possibility that the sheet may be scratched by foreign particles trapped in the wiping member, or that lint from the wiping member itself will be left on the film, or, in the case of brushing, that a portion of the removed dust will again settle on the cleaned sheet.

German Auslegeschrift No. 1,077,960, considered the closest prior art to the present invention, suggests a pair of cleaning rollers which have sufficient surface attraction so that the surface of the roller can contact and remove foreign particles from the surfaces of a sheet to be printed. The rollers roll over the surface of the sheet to be cleaned, thereby eliminating the aforementioned problems with wiping or brushing of the sheet. The dust collected on the cleaning roller of this device, however, is removed by a damp wiping of the cleaning roll surface, which, if the device were used with photographic film, would present the possibility that the cleaning liquid could be carried into contact with and damage the film. Also, there is no teaching in this German patent of a cleaning roll structure which affords the cleaning of lantern slides (e.g. conventional 35 millimeter lantern slides) wherein the film for which surface cleaning is desired is laminated in a surrounding frame which projects from both surfaces of the film.

SUMMARY OF THE INVENTION

The present invention provides a simple and thorough method for cleaning foreign particles from at least one surface of a sheet which includes the steps of (1) passing the surface of a sheet to be cleaned in intimate rolling contact generally tangentially across a cleaning roller which has sufficient surface tack to transfer foreign particles from the surface of the sheet to the surface of the cleaning roller, and (2) cleaning accumulated foreign particles from the surface of the cleaning roller by bringing into rolling contact therewith a surface on a roller cleaning member having a greater surface tack than the surface of the cleaning roller; together with a device for performing the method which may be constructed in a wide variety of embodiments, each specially adapted for a particular cleaning function. Thus the foreign particles are removed from the cleaning roller to prevent masking of its surface which would make it less efficient for subsequent cleaning of sheets, without the use of liquid cleaning which could damage the film being cleaned.

The method according to the present invention may be used for cleaning lantern slides by providing a cleaning roller having a tacky peripheral surface defined by a thickness of low durometer materials so that during rolling contact over a lantern slide the low durometer materials can be pressed against and extruded into the opening in the frame to bring the tacky surface of the cleaning roller into contact with essentially the entire surface of the exposed film.

The peripheral surface of each cleaning roller should be provided by a layer of resilient compressible material which has a surface tack or adhesion sufficiently high to transfer dust particles from a sheet, such as a wafer or photographic film (referred to herein as "tacky"), but which surface material will not transfer to the surface or deform or delaminate a sheet being cleaned.

The peripheral surface of each cleaning roller should also have a finish which is smoother than 16 to 20 microinches to afford intimate and complete contact across the surface of a sheet pressed against the cleaning roller.

Also the durometer of the cleaning roller measured on its peripheral surface must be sufficiently low for its intended use. Cleaning rollers having a thin outer layer or coating with a Shore A durometer value of up to 60 are suitable for cleaning planar sheets or photographic film. However, preferably the outer layer or layers of resilient material defining the peripheral surface of the cleaning roller are over 1/16 inch (0.16 cm) thick and have an overall Shore A durometer value measured on the peripheral surface of the cleaning roller of less than about 20 so that the cleaning roller can both clean planar films such as negatives, and can deform sufficiently to extrude into and clean the film in lantern slides of the type in which the photographic film is laminated in a surrounding frame which projects from both surfaces of the film (e.g. conventional 35 millimeter lantern slides). It has been found that when resilient outer layer or layers of material defining the peripheral surface of the roller have an overall radial thickness of at least ⅛ inch (0.32 cm), an overall Shore A durometer value of less than 20 measured on the peripheral surface and an outside diameter of 0.65 inch (1.65 cm), the cleaning roller can be pressed into the opening in the frame of a lantern slide to clean the photographic film therein within about 0.008 inch (0.02 cm) of the frame, even at its corners.

The surface tack of many elastomeric materials having a Shore A durometer of less than 20 is too great for use in defining the peripheral surface of the cleaning rollers, because separation of the sheet from the material is too difficult, and the material tends to delaminate the paper frame on lantern slides. The proper combination of durometer and surface tack in the resilient outer layers of the cleaning roller can be obtained however, by forming a roller with a relatively thick cylindrical underlayer of an elastomeric polymer of about or slightly less than the durometer desired at the peripheral surface of the cleaning roller, and a thin outer layer (i.e. less than 0.002 inch (0.005 cm) thick, with less than 0.001 inch (0.003 cm) being preferred) of an elastomeric polymer evidencing the proper surface tack characteristics which defines the peripheral surface of the cleaning roller, and which, undesirably, usually has a higher durometer than the underlayer. Rollers comprising a ⅛ inch (0.32 cm) thick underlayer of about 15 Shore A durometer polyether urethane with an about 0.001 inch (0.003 cm) thick outer layer of polyurea urethane elastomer obtained by coating isocyanate terminating prepolymer on the underlayer, which thin outer layer has a Shore A durometer of about 60, have produced excellent results for cleaning lantern slides, and provide a preferred cleaning roller.

The effect of using cleaning rollers having various surface tacks was tested by preparing test cleaning rollers, 2-½ inches (6.35 cm) long, 0.65 inches (1.65 cm) in diameter, and having 0.14 inch (0.36 cm) thick underlayers of polyether urethane with a Shore A durometer of about 15. The underlayers were coated with elastomeric polymers having various surface tacks to provide a surface finish of under 20 microinches. The periphery of each test roller was pressed against a properly supported planar sheet of glass at ambient room temperature until the area of contact was about 0.18 inch (0.46 cm) wide, and held in this condition for about 5 seconds. The roller was then pulled from the sheet, and the force to effect such separation was recorded. Subsequently the rollers were used to clean photographic film, and the results evaluated. Rollers for which the separation force was less than 250 grams were judged to have insufficient surface tack for thorough cleaning of photographic film. Rollers for which the separation force was between 250 grams and 1000 grams were found adequate for cleaning photographic film, with rollers for which this force was between 400 grams and 800 grams being preferred. Rollers for which this force was over 1000 grams sometimes produced delamination of the paper frame around a lantern slide, and had a tackiness that was too close to the tackiness of the preferred roll cleaning member to insure transfer of foreign material therebetween.

The roller cleaning member should have a surface tack which greatly exceeds the surface tack of the cleaning roller to insure transfer of all collected particles from the cleaning roller to the surface of the cleaning member, but should not comprise a material, such as an adhesive, providing the surface tack that will adhere excessively to or transfer to the cleaning roller. A preferred cleaning member comprises a length of pressure sensitive adhesive coated tape disposed adhesive side out. A suitable pressure sensitive tape should have a peel test strength in the range of 20 to 30 ounces per inch or 0.22 to 0.33 kilograms per centimeter (preferably 25 ounces per inch(0.27 kilograms per centimeter) for use with the preferred cleaning roller described above) when tested in accordance with test procedure No. PSTC-1 as specified by the Pressure Sensitive Tape Council, 1201 Waukegan Road, Glenview, Illinois 60025. An example of one suitable tape which has a peel test strength of 25 ounces per inch (0.27 kilograms per centimeter) is the tape sold under the trade designation "Scotch Brand Tape No. 850" by Minnesota Mining and Manufacturing Company, St. Paul, Minnesota.

One embodiment of a device for practicing this method is sufficiently inexpensive that it is economically available to the average amateur photographer for cleaning photographic film. This embodiment of the device includes a pair of the cleaning rollers which rollers may be manually rotated to propel a negative or lantern slide to be cleaned through a nip therebetween and are spaced so that the layers of tacky material on the cleaning rollers will slightly compress on the opposite surfaces of the film, or extrude into the frame of the lantern slide and adhere foreign particles on the film to the surfaces of the cleaning rollers. The roller cleaning member for the device consists of a thin plate having a length of tape wound around its surface adhesive side out, and the operator periodically propels the cleaning member between the rollers to remove collected foreign particles from their surfaces.

Other more automated embodiments of the device, intended for use during the production of integrated circuits or by photographic film printing companies, have a pair of spaced cleaning rollers which are driven to propel a sheet along a path between their tacky surfaces, and include means for automatically moving a roll cleaning member along the surface of each cleaning roller to collect the particles during a cleaning cycle of the device.

Preferably these roll cleaning members comprise means which during each cleaning cycle for the device moves a contact length of pressure sensitive adhesive tape for each cleaning roller sequentially: (1) from a disengaged position spaced from the cleaning roller; (2) to a first engaged position with the adhesive coating at one end of the contact length of tape contacting the cleaning roller in an area spaced from the path for the sheet through the device; (3) longitudinally over the cleaning roller for a distance at least equal to the circumference of the cleaning roller; and (4) back to the disengaged position. Preferably the device also includes means for tensioning the contact length of tape along a tape path to prevent it from wrapping around the cleaning roller, and means for incrementally changing each contact length of tape used to collect the particles during each cleaning cycle to insure complete collection of foreign particles from the cleaning rollers.

In some such automated embodiments the cleaning members each include a rotatably mounted drum-like member having a cylindrically arcuate surface about which one of the contact lengths of tape is tensioned adhesive side out for rotation against one of the cleaning rollers, while in another the contact lengths of tape are each supported by pairs of rollers on two carriages which maintain the tension in the tape while allowing it to move longitudinally over one of the cleaning rollers.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENTS

Figure 1:
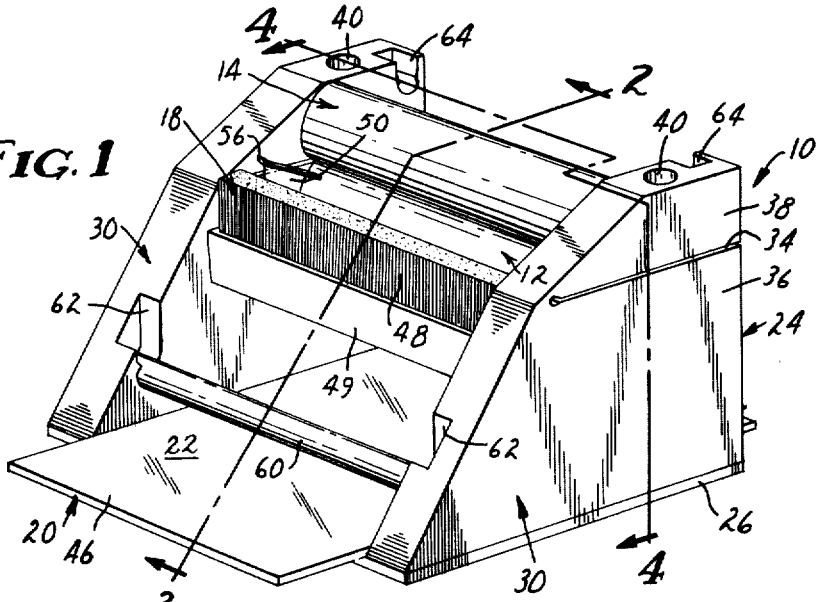
FIG. 1 is a view in perspective of a first embodiment of a device for cleaning sheets according to the present invention.

Referring now to FIGS. 1 through 5 there is shown a first embodiment of a device for cleaning sheets according to the present invention, generally designated by the numeral 10. The device 10 is particularly adapted for use by amateur photographers for cleaning photographic film including strip film, single negatives and lantern slides.

The device 10 comprises a pair of rotatably mounted axially parallel cleaning rollers 12 and 14. Each cleaning roller 12 or 14 comprises a central shaft 32 or 11 respectively, a cylindrical sleeve of a low durometer resilient polymeric material 13 adhered around the shaft 32 or 11 which provides a low overall durometer for the cleaning roller 12 or 14 measured on its peripheral surface to allow it to deform during the cleaning of lantern slides, and a thin coating 15 of an elastic resilient polymeric material around the cylindrical outer periphery of the sleeve 13 defining the peripheral surface of the cleaning roller 12 or 14, and providing a surface tack adapted to transfer foreign particles from the surface of photographic film to the surface of the roller 12 or 14. The roller 12 may be manually rotated via a knob 16 to drive a film 17 to be cleaned through the nip between the rollers 12 and 14 (FIG. 2) so that dirt particles on the film 17 will be transferred to the surfaces of the rollers 12 and 14. A brush 18 of conductive carbonaceous fibers is mounted adjacent one side of the rollers 12 and 14 so that the fibers will contact and remove static electrical charges from a photographic film subsequent to its cleaning. A thin board-like roller cleaning member 20 is provided with contact surfaces 22 having a higher tack than the surface tack of the rollers 12 and 14. The roller cleaning member 20 may periodically be manually inserted and driven between the cleaning rollers 12 and 14 (FIG. 3) to transfer foreign particles collected on the peripheral surfaces of the cleaning rollers 12 and 14 to the surface of the roller cleaning member 20.

The device 10 comprises a frame 24 having a base plate 26 supported on rubber feed 28 on which base plate 26 the roller cleaning member 20 may be stored when not in use, and spaced parallel upstanding side walls 30 between which the shafts 32 and 11 of the cleaning rollers 12 and 14 are journaled. The shaft 32 of the lower roller 12 extends through one side wall 30 and has the knob 16 fixedly attached at its outboard end.

The side walls 30 mount the upper roller 14 for movement away from the lower roller 12 to facilitate movement of a photographic film or the roller cleaning member 20 therebetween, and means are provided for biasing the upper roller 14 toward the lower roller 12 to provide a pressure required for intimate contact between the rollers 12 and 14 and a photographic film being cleaned. The side walls 30 each have a horizontal slot 34 between the rollers 12 and 14 which is between a bottom portion 36 of the side wall 30 in which the bottom roller 12 is journaled and a top portion 38 in which the top roller 14 is journaled. The portions 36 and 38 are joined together over only a small area at one end of the slot 34 and the material of the side wall 30 (e.g. Delrin) is sufficiently flexible that said small area will provide a hinge to allow movement between the portions 36 and 38 and the rollers 12 and 14.

Figure 4:
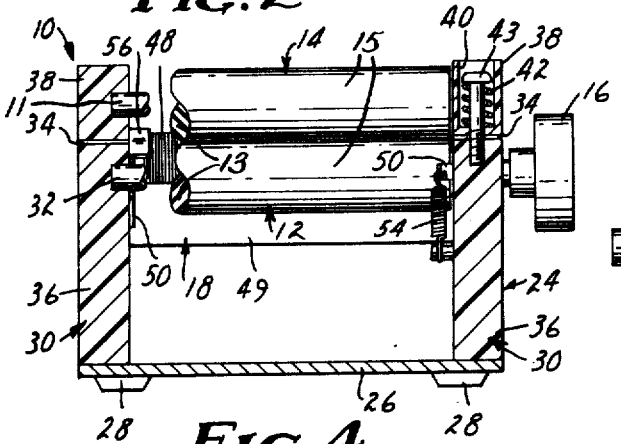
FIG. 4 is a sectional view taken approximately along the lines 4—4 of FIG. 1 with parts broken away to show detail.

Each top portions 38 has a socket 40 in which a coil spring 42 is retained under the head of a screw 43 (FIGS. 1 and 4). The screw 43 passes through the spring 42 and a clearance hole in the top portion 38, and threadably engages the bottom portion 36. The springs 42 bias the upper cleaning roller 14 toward the lower cleaning roller 12, and the upper cleaning roller 14 must move away from the lower cleaning roller 12 against the bias of the springs 42 to accommodate a photographic film (including a lantern slide) or the roller cleaning member 20 between the cleaning rollers 12 and 14.

The roller cleaning member 20 has a width only slightly less than the distance between the side walls 30 to afford full width cleaning of the peripheral surface on the cleaning rollers 12 and 14. As best seen in FIG.

3, the roller cleaning member 20 consists of a thin plate 44 of stiff material such as a rigid plastic about which is wrapped a length of pressure sensitive adhesive coated tape 46 (which may be single or double coated) with an adhesive side out to provide the high surface tack for the roller cleaning member 20. The wraps of the tape 46 are each transversely cut adjacent one end of the plate 44 so that when the adhesive on an outer wrap of tape becomes so loaded with dirt particles that it will no longer efficiently clean the cleaning rollers 12 and 14, the outer wrap can be conveniently peeled away to expose a clean inner wrap.

The brush 18 is of the type disclosed in U.S. Pat. No. 3,757,164 and is constructed according to the method disclosed in U.S. Pat. No. 3,689,117, the disclosures whereof are incorporated herein by reference. The brush comprises a multiplicity of resilient supple, conductive carbonaceous filaments 48 projecting from and adhered in a metal support 49.

The device includes means for moving the brush 18 away from the nip of the cleaning rollers 12 and 14 during movement of the roller cleaning member 20 therebetween (FIG. 3) to prevent adhesion between the brush filaments 48 and the adjacent surface of the roller cleaning member 20.

Figure 2:
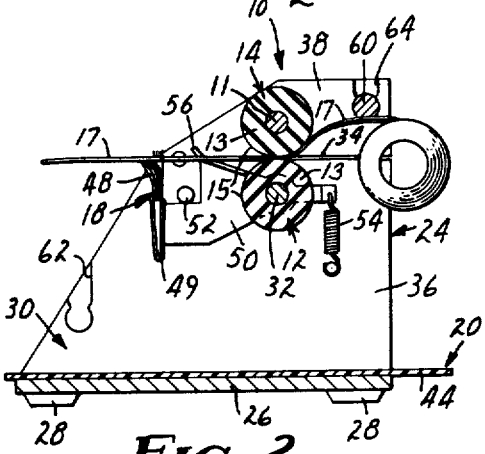
FIG. 2 is a sectional view of the device of FIG. 1 taken approximately along the lines 2—2 and illustrating the cleaning of a coil of photographic film between a pair of cleaning rollers on the device.
Figure 3:
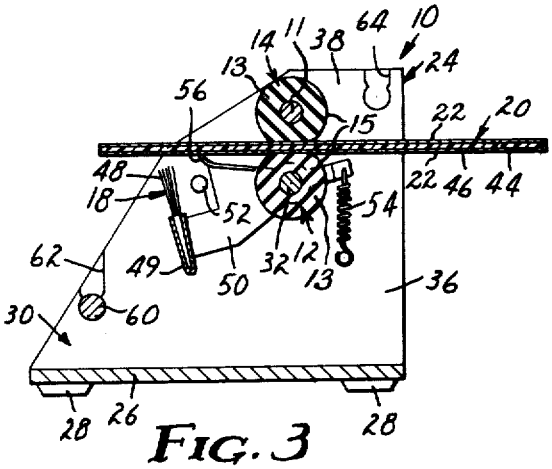
FIG. 3 is a sectional view of the device of FIG. 1 taken approximately along the lines 2—2 and illustrating the use of a roller cleaning member to clean foreign material from the cleaning rollers.

As is best seen in FIGS. 2 and 3, the brush 18 is pivotally mounted about the shaft 32 for the lower cleaning roller 12 by a bracket 50 at each of its ends. The brush 18 may be pivoted between a normal position established by abutment of an edge on one bracket 50 against a pin 52 fixed to the frame 24 (FIG. 2) with the filaments 48 positioned to contact the adjacent surface of a photographic film or lantern slide driven between the nip of the cleaning rollers 12 and 14; and a second position with the brush fibers 48 spaced from a planar object moving between the cleaning rollers 12 and 14 (FIG. 3). A spring 54 is attached between the frame 24 and one of the brackets 50 and provides means for biasing the brush 18 to its normal position. The brackets 50 each include a narrow shoe 56 closely spaced from the adjacent side wall 30. The shoes 56 each are shaped to provide a camming surface aligned to be contacted by a planar object moving between the cleaning rollers 12 and 14 with one edge positioned closely adjacent the side wall 30, and to cause movement of the brush 18 to its second position as the end of the planar object moves across the upturned ends of the shoes 56 opposite the cleaning rollers 12 and 14. Since the device 10 is designed to clean photographic films and lantern slides which are more narrow in width than the distance between the side walls 30, such films or slides, if somewhat centered between the side walls 30, will not contact the shoe 56 to move the brush 18 to its second position (FIG. 2). The roller cleaning member 20, however, is only slightly less narrow in width than the distance between the side walls 30 so that it will contact both of the shoes 46 and move the brush 18 to its second position as it passes between the cleaning rollers 12 and 14 (FIG. 3).

Figure 5:
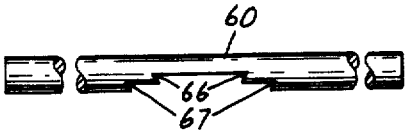
FIG. 5 is an enlarged fragmentary view of a bar on the device of FIG. 1 for supporting a coil of photographic film to be cleaned.
Figure 6:
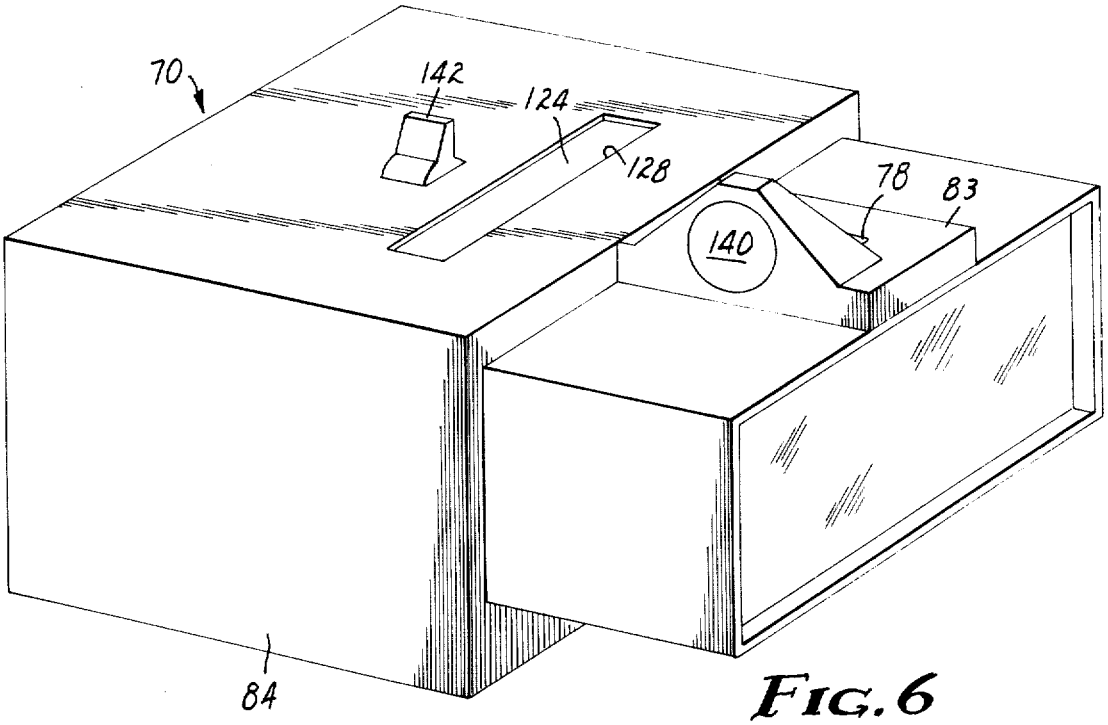
FIG. 6 is a view in perspective of a second embodiment of a device according to the present invention for cleaning sheets which is particularly adapted for the cleaning of lantern slides.

The device 10 also includes means for unrolling a coiled length of photographic film 17 to be cleaned by the cleaning rollers 12 and 14. A specially shaped rod 60 (intended to be stored between an opposed pair of recesses 62 in the side walls 30 as illustrated in FIG. 1 when flat photographic films or lantern slides are being cleaned) may be manually positioned between a pair of recesses 64 in the side walls 30 adjacent the inlet side of the cleaning rollers 12 and 14 as is shown in FIG. 2. The rod 60, as is best seen in FIG. 5, has nested narrow and wide generally centrally located pairs of notches 66 and 67. The notches 66 and 67 are aligned generally transverse to the axis of the rod 60, and each pair of notches 66 or 67 is spaced to engage the edges of a film for which it is sized and to bow the center of that film outwardly away from the rod 60. The coil of film 17 is placed as is illustrated in FIG. 2 so that the longitudinal arc caused in the film by engagement of its edges in the notches 66 or 67 straightens the transverse arc of the film 17 in the coil. This causes the film to leave the coil in a tangent thereto to be pulled between the rollers 12 and 14, while the coil is supported only by edge contact with the length of film in the pair of notches 66 or 67. This simple support eliminates the need of a reel to support the coil of film (which coil if unsupported would be pulled against the rollers 12 and 14).

Referring now to FIGS. 6 through 12 there is shown a second embodiment of a device for cleaning sheets according to the present invention, generally designated by the numeral 70. The device 70 is particularly adapted for cleaning lantern slides, although it will be appreciated that the device 70 may be adapted for cleaning generally parallel opposite surfaces on a wide variety of objects, even where those surfaces have irregularities with a depth similar to the window in a lantern slide.

Like the device 10, the device 70 comprises first and second cleaning rollers, 72 and 73 respectively, rotatably mounted in axially parallel relationship and spaced so that their adjacent portions will be compressed when a lantern slide 71 is passed through the nip therebetween. Each cleaning roller, 72 or 73, comprises a central shaft 74, a cylindrical sleeve 75 of a low durometer polymeric material adhered around the shaft 74, and a thin coating 76 of an elastic polymeric material around the cylindrical outer periphery of the sleeve 75. The low durometer sleeve 75 (e.g. 15 durometer) is selected to afford deformation of the cleaning roller 72 or 73 so that its periphery can conform to the window in a lantern slide, while the coating 76 is selected to provide a peripheral surface having a surface tack adapted to adhere to foreign particles on the adjacent surface of a lantern slide passed between the cleaning rollers 72 and 73 and transfer the foreign particles from the slide to the cleaning roller 72 or 73.

During a cleaning cycle of the device 70 to clean one lantern slide 71, the cleaning rollers 72 and 73 are rotated by a drive means (later to be explained) through a predetermined angle in one direction of rotation to move the lantern slide 71, which is initially inserted by an operator in an inlet opening 78 in a block-like member 83 fixed to a frame 84 of the device 70 (FIG. 8), along a path (FIG. 9) completely through the nip between the cleaning rollers 72 and 73, and into a generally U-shaped hopper 85 (FIG. 10) having an opening oriented to receive lantern slides driven between the cleaning rollers 72 and 73, and a pad of resilient sponge-like material 86 in its end opposite the opening. The resilient pad 86 is positioned to be compressed by the leading edge of the slide before it leaves the nip between the cleaning rollers 72 and 73. Thus the resilient pad 86 provides means for resiliently urging a lantern slide within the hopper 85 back into the nip between the cleaning rollers 72 and 73. The drive means then rotates the cleaning rollers 72 and 73 through the same predetermined angle in the opposite direction of rotation. The resilient pad 86 insures reengagement of the slide in the nip between the cleaning rollers 72 and 73 to move it back through the cleaning rollers 72 and 73 and again position it in the inlet opening 78 from whence it may be removed by the operator.

The device 70 includes two rotary roller cleaning members adapted for cleaning the cleaning rollers 72 and 73, which roller cleaning members have a contact surface with greater surface tack with respect to foreign material to be removed than do the peripheral surfaces of the cleaning rollers 72 and 73. During each cleaning cycle of the device 70 one of the roller cleaning members is moved in rolling contact along the periphery of one of the cleaning rollers 72 or 73 to transfer the foreign material removed from the lantern slide to the cleaning member; thereby insuring that the surface portion of the cleaning roller 72 or 73 contacting the lantern slide is always clean.

Figure 8:
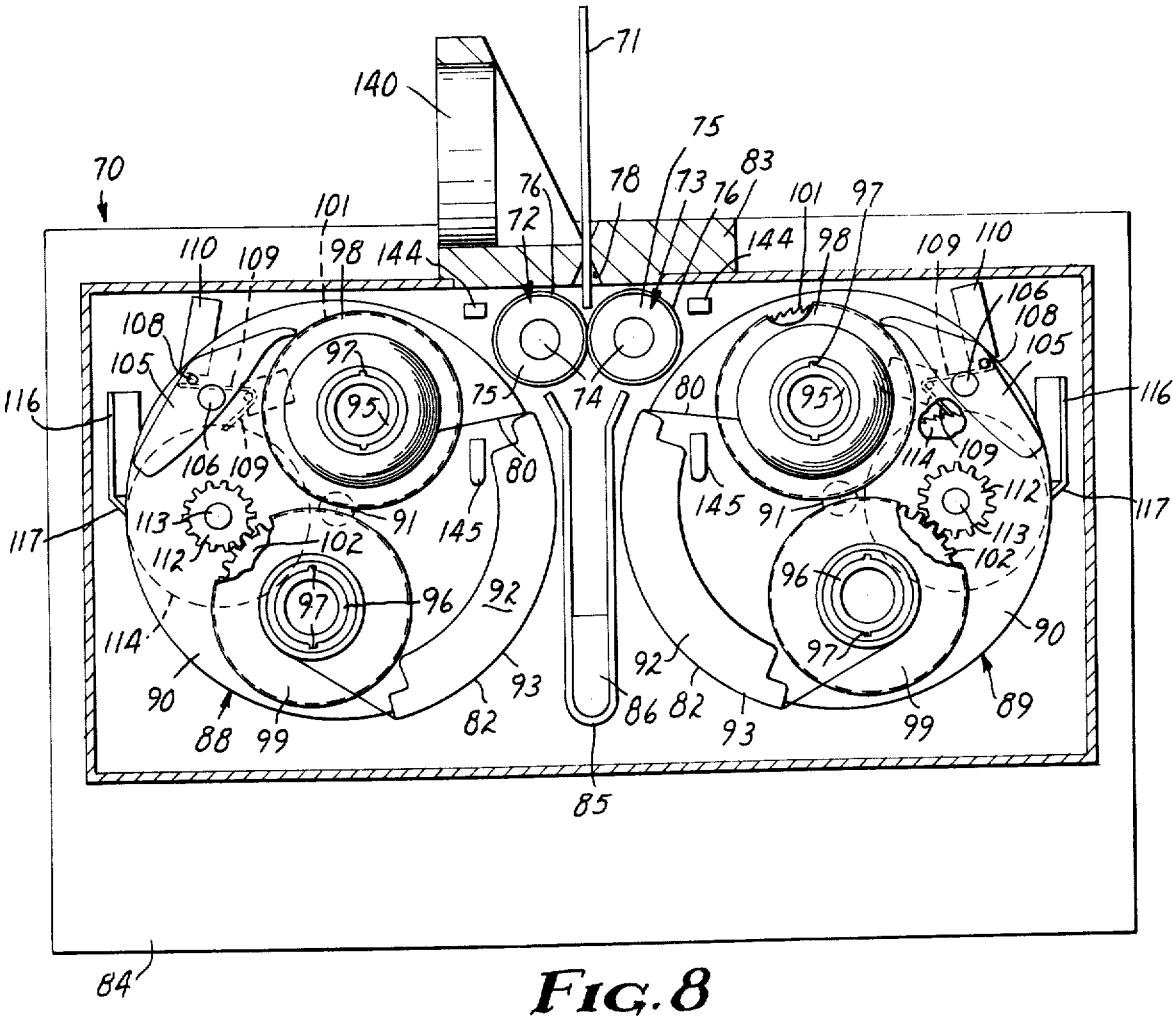
FIGS. 8, 9 and 10 are sectional views taken approximately along the lines 8—8 of FIG. 7 which sequentially illustrate the cycle of the device for cleaning a lantern slide.

Each roll cleaning member comprises a supply length of tape 80 having a width approximately the same as the coated tacky peripheral surface of the cleaning roller 72 or 73 with which it is associated, and means for moving a contact length 82 of the supply length of tape 80 sequentially (1) from a disengaged position (FIG. 8) spaced from the cleaning roller 72 or 73; (2) to a first engaged position with the adhesive coating on one end of the contact length of tape 82 in generally tangential line contact with the periphery of the cleaning rollers 72 or 73 in an area spaced from the path for lantern slides between the cleaning rollers 72 and 73; (3) longitudinally over the cleaning roller 72 or 73 with rolling contact between the cleaning roller 72 or 73 and the adhesive coating on the contact length of tape 82 to move the line of contact therebetween from one end toward the other and for a distance at least equal to the circumference of the cleaning roller 72 or 73; and (4) back to the disengaged position (FIG. 8).

The means for sequentially moving each contact length of tape 82 in this pattern includes a first drum-like member 88 associated with the first cleaning roller 72, and a second drum-like member 89 associated with the second cleaning roller 73. Each drum-like member 88 or 89 includes a circular end plate 90, a shaft 91 coaxially fixed to the end plate 90 and rotatably mounted in the frame 84 axially parallel to the shafts 74 in the cleaning rollers 72 and 73, and an arcuate member 92 projecting generally normally from the end plate 90 and having a peripheral surface portion 93 which is cylindrically convex about the axis of the shaft 91, and which is adapted to entirely support the non-adhesive surface of one of the contact lengths of tape 82. The end plate 90 of each drum-like member 88 and 89 rotatably supports a pair of hubs 95 and 96 axially parallel with the shaft 91. The hubs 95 and 96 each have a pair of opposed outwardly projecting axially extending ridges 97 on their peripheries adapted to engage mating slots in a supply spool 98 and a take-up spool 99, each adapted to support a wound end portion of the supply length of tape 80. A tape path on each drum-like member 88 or 89 is defined by the supply spool 98 which supports an unused end portion of the supply length of tape 80, the peripheral surface portion 93 of the arcuate member 92 along which the contact length of tape 82 is supported, and the take-up spool 99 on which is wound the used portion of the supply length of tape 80.

During a cleaning cycle of the device 70 the drive means rotates the drum-like members 88 and 89 in opposite directions with each drum-like member 88 and 89 rotating from a disengaged position (FIG. 8) with the arcuate member 92 spaced from the adjacent cleaning rollers 72 or 73, through an intermediate first engaged position at which one end of the contact length of tape 82 on the peripheral surface portion 93 contacts the peripheral surface of the adjacent cleaning roller 72 or 73, and then to an end position (FIG. 10) with rolling contact between the contact length of tape 82 and the cleaning roller 72 or 73 and the contact length of tape 82 moving longitudinally over the cleaning roller 72 or 73. The cleaning rollers 72 and 73 and the arcuate members 92 are sized to provide such rolling contact for a distance at least equal to the circumference of the cleaning rollers 72 and 73. From the end position, the drive means rotates the drum-like members 88 and 89 in the opposite direction of rotation during reverse rotation of the cleaning rollers 72 and 73 to return the drum-like members 88 and 89 to their disengaged position.

The device 70 also includes means for incrementally changing the portion of each supply length 80 of tape which comprises the contact length 82 thereof during each cleaning cycle of the device 70 which is incorporated with means associated with each drum-like member 88 and 89 for fixing the ends of the contact length of tape 82 along the peripheral surface portion 93 of the arcuate member 92 to prevent the contact length of tape 82 from adhering to and winding around the periphery of the cleaning roller 72 or 73 during a cleaning cycle of the device 70.

Figure 7:
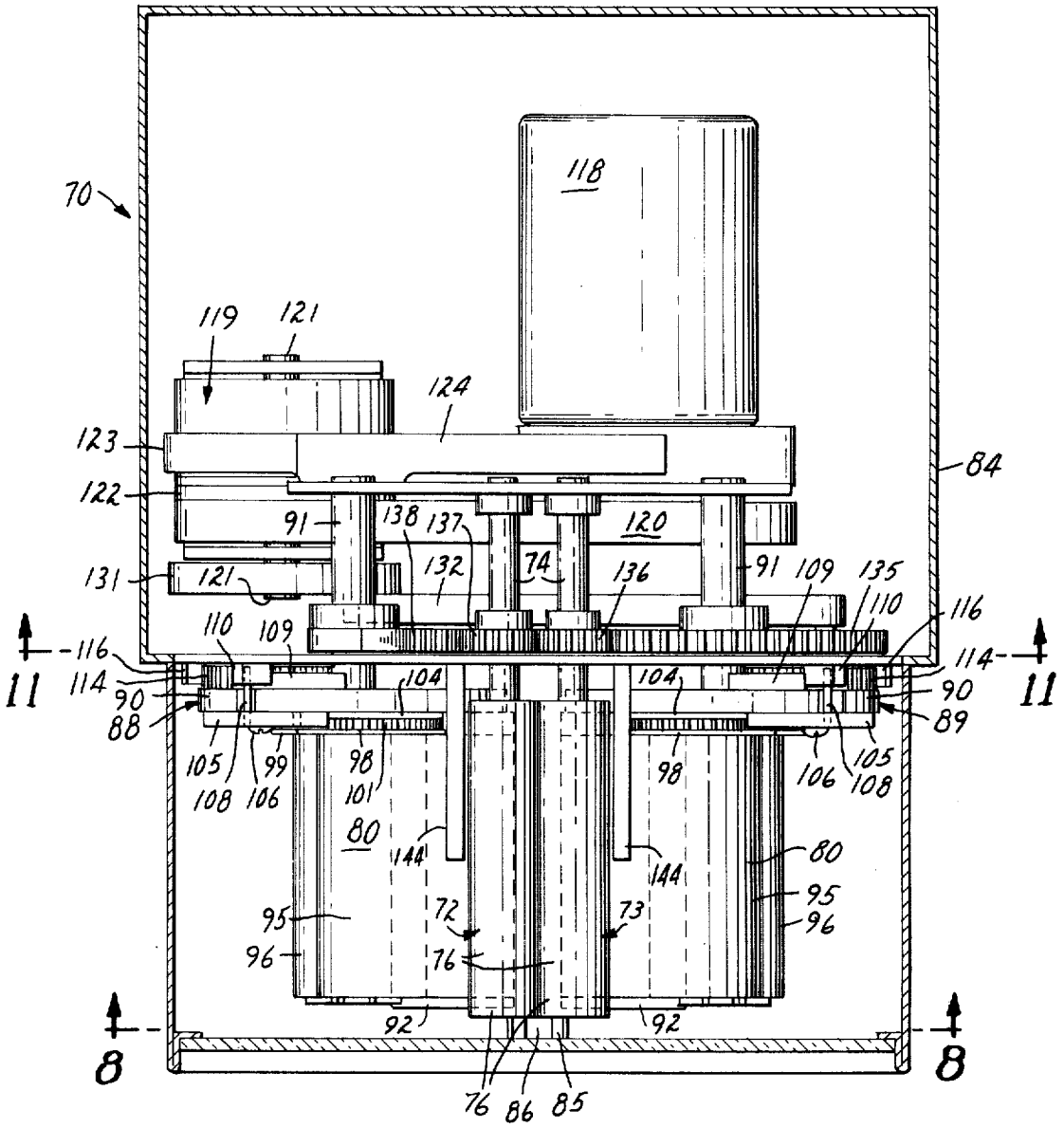
FIG. 7 is an enlarged horizontal sectional view of the device of FIG. 6.
Figure 9:
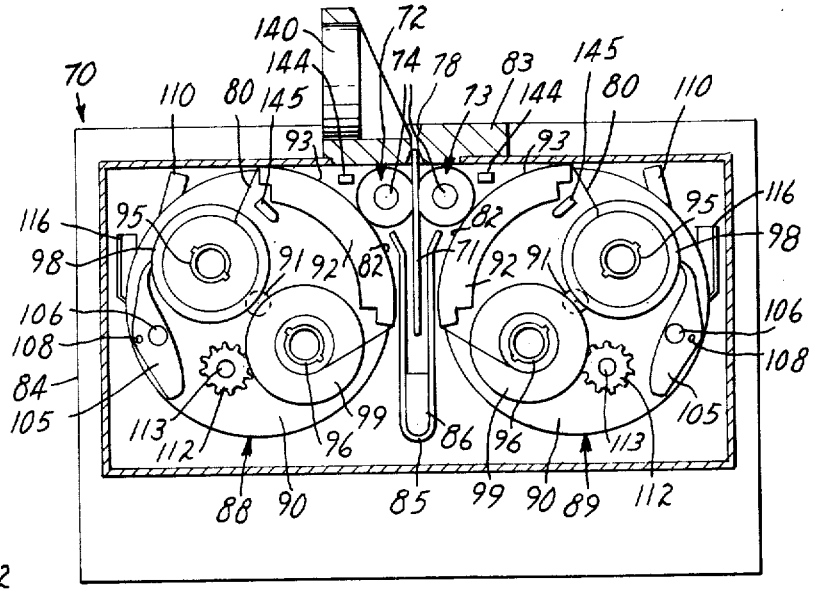
Figure 10:
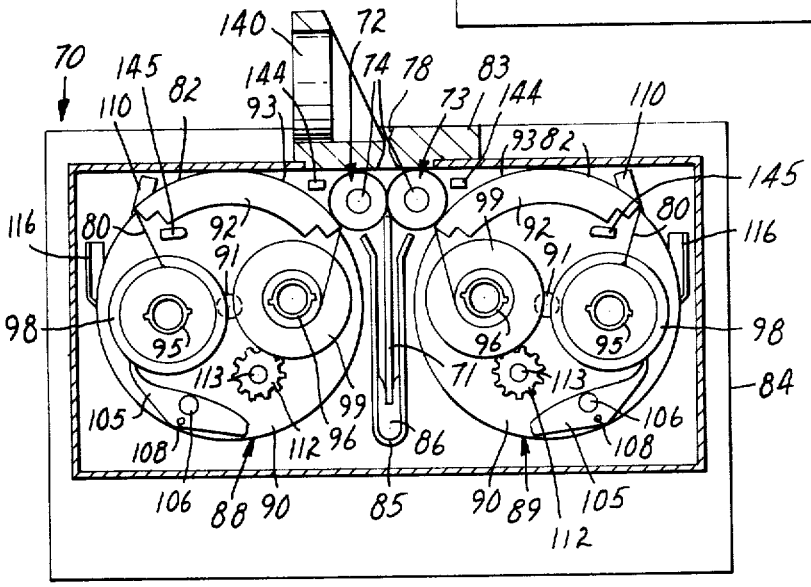

As is seen in FIGS. 7 and 8, in each of the drum-like members 88 and 89 the hub 95 for the supply spool 98 is fixed to a ratchet wheel 101, and the hub 96 for the take-up spool 99 is fixed to a spur gear 102, both at their ends adjacent the end plate 90. A pad of frictional material 104 (e.g. cork) is pressed between the ratchet wheel 101 and the end plate 90 to frictionally restrict rotation of the supply spool 98. A pawl 105 is pivotably mounted at a shaft 106 fixed to the end plate 90. The pawl 105 is biased to engage an end thereof with teeth on the ratchet wheel 101 by means including a pin 108 fixed to the pawl 105 and projecting through a notch in the end plate 90, and a U-shaped leaf spring 109 with an end bearing against the pin 108 and its central portion fixed to the end plate 90. The pin 108 is adapted to contact a block 110 adjustably fixed to the frame 84 upon rotation of the drum-like member 88 or 89 to its disengaged position, thereby lifting the end of the pawl 105 from engagement with the ratchet wheel 101. Upon rotation of the drum-like member 88 or 89 from its disengaged toward its first engaged position, however, the pin 108 moves out of engagement with the block 110 allowing the end of the pawl 105 to engage an adjacent notch in the ratchet wheel 101 and prevent rotation of the supply spool 98.

The spur gear 102 on the hub 96 for the take-up spool 99 in each drum-like member 88 or 89 is engaged by a gear 112 fixed to a shaft 113 rotatably mounted in the end plate 94 and having fixed to its opposite end a ratchet gear 114. The ratchet gear 114, and thereby the take-up spool 99, is prevented from rotating in a direction affording unwinding of the used portion of the supply length of tape 80 by a second end of the U-shaped leaf spring 109 which is biased against the side of an adjacent tooth on the ratchet gear 114. Thus after the drum-like member 88 or 89 rotates to move the pin 108 away from the block 110, the pawl 105 and the end of the leaf spring 109 engaged with the gear 114 prevent the tape from being unwound from either of the spools 98 or 99 as the contact length of tape 82 on its peripheral surface moves along the associated cleaning roller 72 or 73.

Two spring pawls 116 of spring tempered steel are fixed to the frame 84, one adjacent each drum-like member 88 or 89, and each has a projecting end portion 117 positioned to engage the side of a tooth on the ratchet gear 114 on the associated drum-like member 88 or 89 and rotate it through a predetermined angle to advance the supply length of tape 80 a predetermined distance from the supply spool 98 to the take-up spool 99 upon rotation of the drum-like member 88 or 89 from its end position back to its disengaged position. For each drum-like member 88 or 89, the block 110 is positioned so that engagement of the spring pawl 116 with the gear 114 is simultaneous with engagement between the block 110 and the pin 108. Thus the pawl 105 is lifted from the ratchet wheel 101 to allow rotation of the spool 98 against the retarding force of the friction member 104 as the supply length of tape 80 is advanced to incrementally change the contact length of tape 82 on the arcuate member 92.

Figure 11:
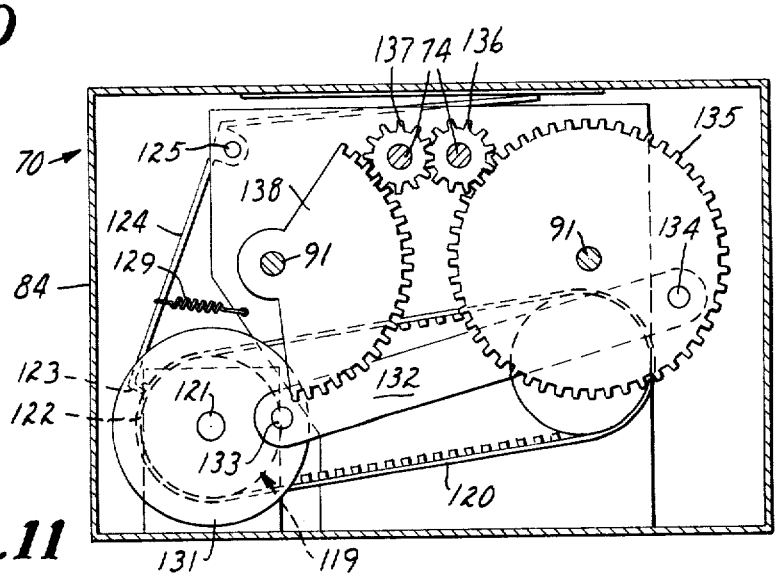
FIG. 11 is a sectional view taken approximately along the lines 11—11 of FIG. 7.
Figure 17:
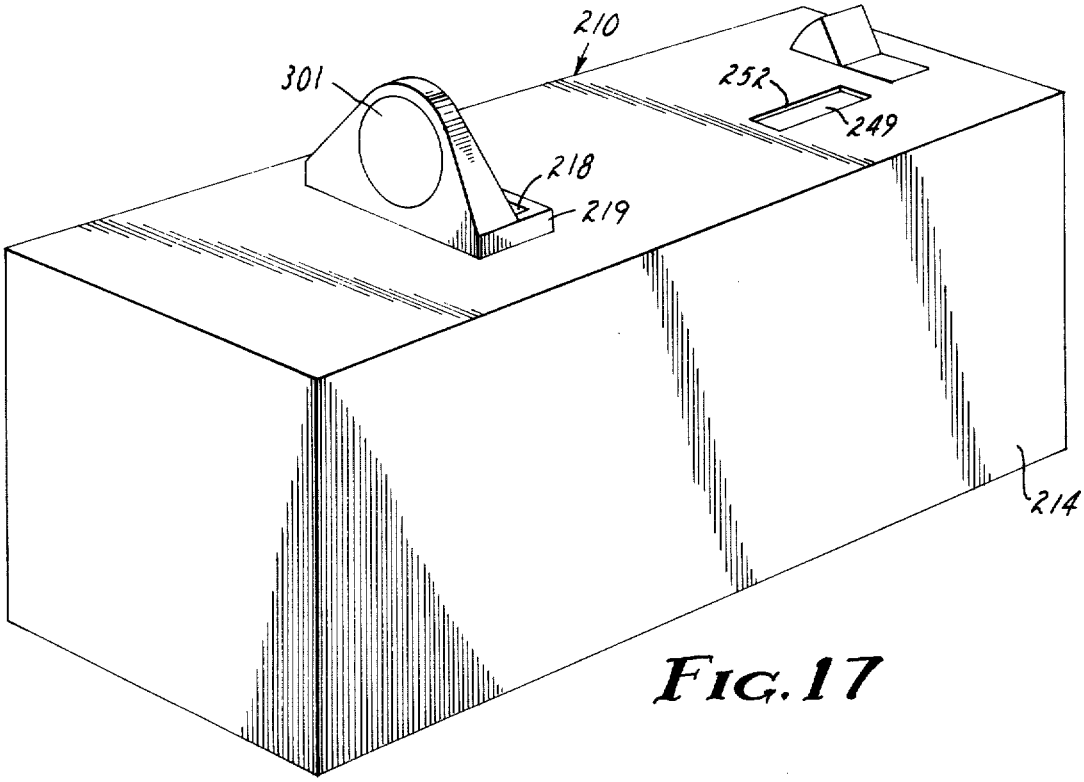
FIG. 17 is a view in perspective of a fourth embodiment of a device for cleaning sheets according to the present invention which is particularly adapted for the cleaning of lantern slides.
Figure 18:
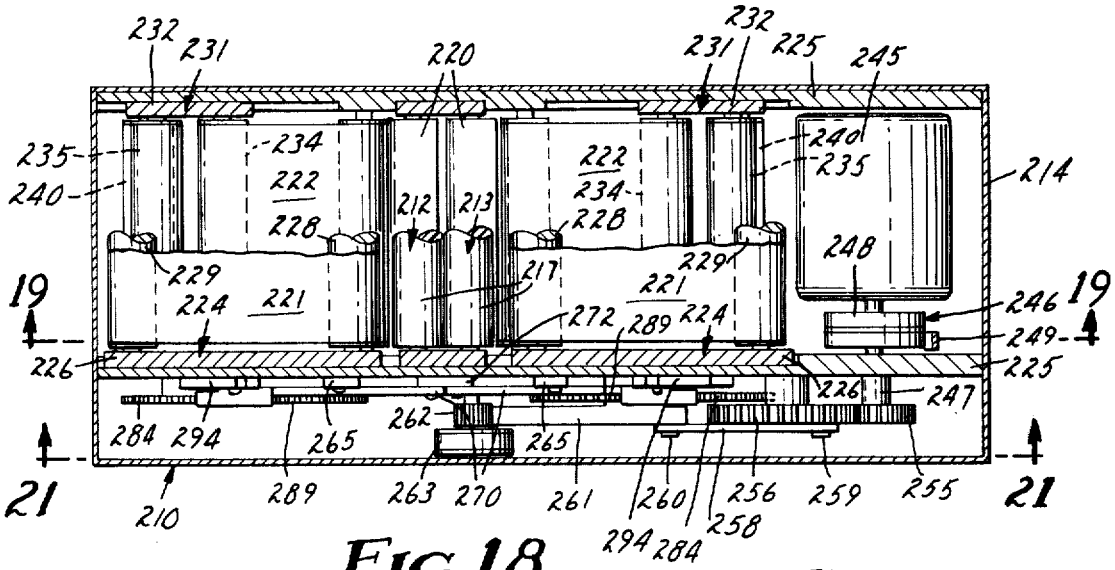
FIG. 18 is a horizontal sectional view, of the device of FIG. 17.
Figure 12:
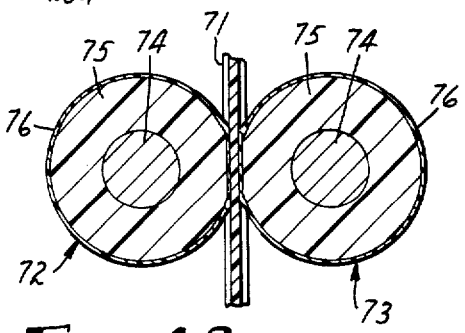
FIG. 12 is a fragmentary enlarged view of cleaning rollers in the device of FIG. 6 illustrated with a lantern slide therebetween.

The drive means for the device 70 best seen in FIGS. 7 and 11 includes a gear reduced motor 118 in driving engagement with the input side of a single revolution clutch 119 via a timing belt and gear assembly 120. The single revolution clutch 119 is the type sold under the trade designation Series C No. C-43-3 by Marquette Metal Products Company, 1145 Galewood Drive, Cleveland, Ohio. The clutch 119 has a central output shaft 121 rotatably mounted on the frame 84 and an outer collar 122 having a projection adapted for engagement by an end 123 of a stop arm 124 pivotably mounted on the frame 84 at a pin 125. The stop arm 124 is manually engageable through a slot 128 in the top surface of the frame 84 to move the stop arm 124 against the bias of a spring 129 from an engaged position (FIG. 11) engaged with the projection on the collar 122, and a release position spaced from the projection which affords engagement of the clutch 119 for a single revolution of the output shaft 121 until the projection is again engaged by the end 123 of the stop arm 124 (if the stop arm 124 is released) to disengage the clutch 119. A drive wheel 131 is fixed to the output shaft 121. Upon engagement of the clutch 119 the motor 118 drives the drive wheel 131 for one complete rotation and the drive wheel 131 acts as a crank to drive an arm 132 pivotably mounted at pins 133 and 134 respectively between the drive wheel 131 and a large spur gear 135. The drive wheel 131 rotates the large spur gear 135 for a partial revolution in a first direction of rotation during the first 180° of its rotation, and then back to its original position in the opposite direction of rotation during the last 180° of its rotation. The large spur gear 135 is fixed to the shaft 91 of the first drum-like member 88, and drives a gear train including a pair of equal sized meshed spur gears 136 and 137 fixed respectively to the shafts 74 of the cleaning rollers 72 and 73, and a sector gear 138 fixed to the shaft 91 of the second drum-like member 89 which has the same pitch diameter as the large spur gear 135. The size ratio between the spur gears 136 and the sector 138 and spur gear 135 is selected to provide rolling engagement between the peripheries of the cleaning rollers 72 and 73 and the contact lengths of tape 82 upon contact therebetween during a cleaning cycle of the device 70.

The device 70 also includes means for neutralizing static electric charges on a clean lantern slide, thereby restricting the attraction of a cleaned lantern slide to dust particles in the air. An alpha particle source 140 comprising a quantity of polonium encapsulated in particles or spheres as described in U.S. Pat. No. 3,147,225 (incorporated herein by reference) and disposed on a support is fixed in an opening in the block-like member 85 adjacent the inlet opening 78. The air adjacent the inlet opening 78 is ionized because of alpha particles emitted from the polonium and will remove most of the static electric charges from the lantern slide (which may be increased by the cleaning process) after the cleaning cycle of the device 70.

Also, the device 70 includes means for sensing the ends of the supply lengths of tape 80 to prevent separation thereof from the supply spools 98 and resultant wrapping of the tape on the cleaning rollers 72 and 73 during a subsequent cleaning cycle. The supply lengths of tape 80 are translucent. An opaque transverse strip is adhered to each supply length of tape 80 adjacent its end first wound on the supply spool 98. A light sensor 144 mounted on the frame 84 is positioned on one side of the portion of each of the supply lengths of tape 80 between the arcuate member 92 and supply spool 98 for the supporting drum-like member 88 or 89 when in its disengage position. A curved light pipe 145 is mounted on each of the drum-like members 88 and 89, and communicates between the side of the tape opposite the sensor 144 and a source of light at an opening in the frame 84 when the drum-like members 88 and 89 are in their disengaged position. A control circuit prevents activation of the motor 118 if light is not received from the light pipe 145 by both the sensors 144 with the drum-like members 88 and 89 in their disengaged position, which will occur when either of the strips on the tape passes therebetween. This signals the operator that a new supply length of tape 80 must be inserted.

To operate the device, the operator turns on an electrical switch 142 to activate the motor 118. Initially the cleaning rollers 72 and 73 and the drum-like members 88 and 89 are not driven by the motor 118 due to lack of engagement of the clutch 119 in the drive train therebetween. The operator positions a lantern slide to be cleaned in the inlet opening 78 so that its inner edge rests against the nip between the cleaning rollers 72 and 73 (FIG. 8). The operator then depresses the portion of the stop arm 124 exposed through the slot 128 in the top of the device 70, which removes its end 123 from engagement with the clutch 119 so that the clutch 119 is engaged for one 360° revolution of its output shaft 121. Via the drive wheel 131, arm 132 and gear train 135, 136 and 137, the first 180° of such revolution causes the cleaning rollers 72 and 73 to rotate in opposite directions to drive the lantern slide through the nip therebetween (FIG. 9) and into the U-shaped hopper 85 (FIG. 10), thereby deforming the cleaning rollers (FIG. 12) and adhering any foreign material on the lantern slide to the tacky surfaces of the cleaning rollers 72 and 73. Also via the gears 135 and 138 the drum-like members 88 and 89 are rotated to move the contact lengths of tape 82 on the peripheral surface portions 93 thereof from a disengaged position spaced from the cleaning rollers 72 and 73 (FIG. 8), through their first engaged position contacting the cleaning rollers 72 and 73, and subsequently longitudinally along the peripheral surfaces of the associated cleaning roller 72 or 73 with rolling contact therebetween (FIG.

9) so that the adhesive coating on the contact length of tape 82 will preferentially adhere to foreign material on the cleaning rollers 72 and 73 and transfer it to the contact lengths of tape 82. At this stage of the cleaning cycle, the lantern slide has been driven entirely into the U-shaped hopper 85 (FIG. 10) and its leading edge compresses the resilient pad 86 so that the adjacent edge of the slide is biased toward the nip between the cleaning rollers 72 and 73. Because of the drive connection provided by the arm 132, the cleaning rollers 72 and 73 are then rotated in the reverse direction during the last 180° rotation of the drive wheel 131 so that the lantern slide will again be driven between the cleaning rollers 72 and 73 and be expelled into the inlet opening 78 adjacent the nuclear source 140 of alpha radiation (FIG. 7) which removes static electrical charges from the cleaned surfaces thereof. Also the drum-like members 88 and 89 rotate back to their disengaged positions with the contact lengths of tape 82 out of contact with the cleaning rollers 72 and 73. During rolling contact with the cleaning rollers 72 and 73, the contact lengths of tape 82 are prevented from unwinding from the spools 98 and 99 and wrapping on the periphery of the cleaning rollers 72 and 73 by engagement of the pawl 105 with the ratchet wheel 101 coupled to the supply spool 98 and engagement of an end of the leaf spring 109 with the ratchet gear 114 coupled to the take-up spool 99 via the gears 102 and 112. As each of the drum-like members 88 and 89 moves into its disengaged position, the pin 108 on the pawl 105 carried by its end plate 90 contacts one of the blocks 110 fixed to the frame 84 so that the pawl 105 pivots around the shaft 106 and its end moves out of engagement with the ratchet wheel 101. Simultaneously the end 117 of the fixed spring pawl 116 engages one of the teeth on the ratchet gear 114, rotating it incrementally to wind tape from the supply spool 98 onto the take-up spool 99 against the friction of the pad 104 of friction material pressed between the ratchet wheel 101 and end plate 90. This incrementally changes and provides a predetermined tension in the contact length of tape 83 on the peripheral surface portion 93 to insure subsequent proper cleaning of the cleaning rollers 72 and 73.

Referring now to FIGS. 13 through 16 there is shown a third embodiment of a device for cleaning sheets according to the present invention, generally designated by the numeral 151. The device 151 is particularly adapted for cleaning the surfaces of strip material such as strip film, although it will be appreciated that the device 151 may be used for cleaning lantern slides or generally parallel opposite surfaces on a wide variety of objects.

The device 151 comprises two pairs, 152 and 153 of cleaning rollers 154 rotatably mounted in axially parallel relationship on a frame 158 for the device 151, with the cleaning rollers 154 in each pair 152 or 153 spaced so that their adjacent portions will be compressed when a strip of film 150 is passed through the nip therebetween. Like the cleaning rollers 72 and 73 of the device 70, each cleaning roller 154 comprises a central shaft 155; a cylindrical sleeve 156 of a low durometer polymeric material adhered around the shaft 155 which affords deformation of the cleaning roller to afford intimate contact between its surface and the surface of a film being cleaned; and a thin coating 157 of an elastic polymeric material around the cylindrical outer periphery of the sleeve 156 which provides a peripheral surface having a surface tack adapted to adhere to foreign particles on the adjacent surface of a strip of film between the pairs of the cleaning rollers 154 and transfer the foreign particles from the film to the cleaning rollers 154.

During operation of the device 151 to clean strip film, the cleaning rollers 154 are rotated by a drive means in one direction of rotation to move a strip of film 150 initially inserted by an operator in an inlet opening 159 of the device 151, along a path through the nips between the pairs 152 and 153 of the cleaning rollers 154, and out an outlet opening 160 in the device 151.

Like the device 70, the device 151 includes two rotary roller cleaning members adapted for cleaning the cleaning rollers 154, which roller cleaning members have a greater surface tack with respect to foreign material to be removed than do the peripheral surfaces of the cleaning rollers 154. During each cleaning cycle of the device 151 the drive means moves the cleaning members in rolling contact along the periphery of the cleaning rollers 154 to transfer the foreign material removed from the photographic film by the cleaning member; thereby insuring that the surface portions of the cleaning rollers 154 contacting the photographic film are clean.

Figure 13:
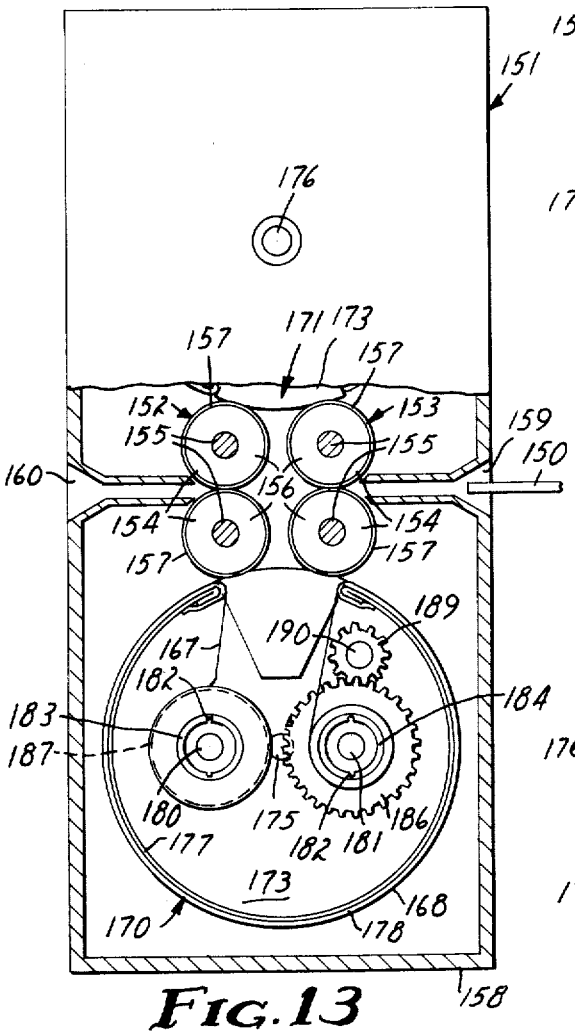
FIG. 13 is a vertical front view, partially in section, of a third embodiment of a device for cleaning sheets according to the present invention.

Like in the device 70, each roller cleaning member comprises a supply length of tape 167 having a width approximately the same as the coated tacky peripheral surface of the cleaning rollers 154 with which it is associated, and means for moving a contact length 168 of the supply length of tape 167 sequentially (1) from a disengaged position (FIG. 13) spaced from the adjacent two cleaning rollers 154; (2) to a first engaged position with the adhesive coating on one end of the contact length of tape 168 in generally tangential line contact with the periphery of one of the adjacent two cleaning rollers 154 in an area spaced from the path for the strip material between the pairs 152 and 153 of the cleaning rollers 154; (3) longitudinally over both of the adjacent two cleaning rollers 154 with rolling contact between the cleaning rollers 154 and the adhesive coating on the contact length of tape 168 to move the line of contact therebetween from one end toward the other and for a distance at least equal to the circumference of the cleaning rollers 154; and (4) back to the disengaged position (FIG. 13).

Like the device 70 the means for moving the contact lengths of tape 168 include a first drum-like member 170 associated with the two cleaning rollers 154 on one side of the path for the strip material through the device 151, and a second drum-like member 171 associated with the two cleaning rollers 154 on the other side of the strip material path. Each drum-like member 170 or 171 includes opposed first and second circular end plates, 173 and 174 respectively, a shaft 175 coaxially fixed to the first end plate 173 and shaft 176 coaxially fixed to the second end plate 174 on which shafts 175 and 176 the drum-like member 170 or 171 is rotatably mounted on the frame 158 parallel to the shafts 155 in the cleaning rollers 154. An arcuate member 177 extends between the end plates 173 and 174 and has a peripheral surface portion 178 which is cylindrically convex about the axis through the shafts 175 and 176, and which is adapted to entirely support the non-adhesive surface of the contact length of tape 168. The first end plate 173 of each drum-like member 170 and 171 rotatably supports a pair of hubs 180 and 181 axially parallel with the shafts 175 and 176. The hubs 180 and 181 each have a pair of opposed outwardly projecting axially extending ridges 182 on their peripheries adapted to removably engage mating slots in a supply spool 183 and a take-up spool 184 each adapted to support a wound end portion of the supply length of tape 167. A tape path on each drum-like member 170 or 171 is defined by the supply spool 183 which supports an unused end portion of the supply length of tape 167, the peripheral surface portion 178 of the arcuate member 177 along which the contact length of tape 168 is supported, and the take-up spool 184 on which is wound the used portion of the supply length of tape 167.

During operation of the device 151 the drive means rotates the drum-like members 170 and 171 in opposite directions with each drum-like member 170 and 171 rotating in one direction from a disengaged position (FIG. 13) with the arcuate member 177 and the contact length of tape 168 thereon spaced from the adjacent cleaning rollers 154, through an intermediate position at which one end of the contact length ot tape 168 on the peripheral surface portion 178 contacts the peripheral surface of the adjacent cleaning roller 154, and then with rolling contact between the contact length of tape 168 and the cleaning rollers 154 for a distance at least equal to the circumference of the cleaning rollers 154, and back to their disengaged position. This cycle is repeated as often as is required to clean the entire length of a strip of film 150.

Figure 14:
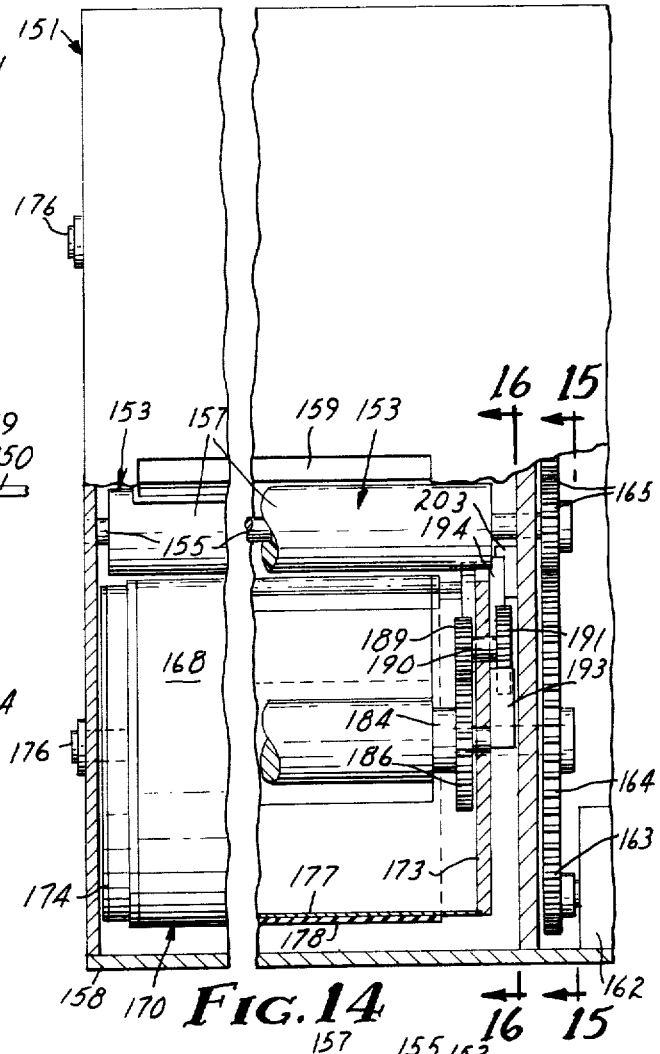
FIG. 14 is a fragmentary vertical side view, partially in section, of the device of FIG. 13.
Figure 15:
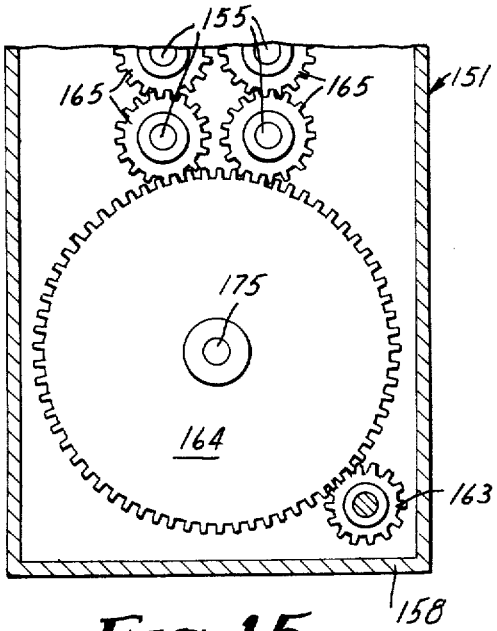
FIG. 15 is a fragmentary sectional view taken approximately along the lines 15—15 of FIG. 14.

The drive means for thus rotating the pairs of cleaning rollers 154, seen in FIGS. 14 and 15, comprises a gear reduced motor 162 having a gear 163 on its output shaft which drives a gear train including a large gear 164 fixed to the shaft 175 of the first drum-like member 170, a cluster of gears 165 each of which is the same size and is fixed on the shaft 155 of one of the cleaning rollers 154 with the two gears 165 on each pair 152 and 153 of the cleaning rollers 154 being in mesh, and a large gear (not shown) fixed to the shaft 175 of the second drum-like member 171.

Like in the device 70, the device 151 includes means for incrementally changing the portion of each supply length 167 of tape which comprises the contact length 168 thereof during each cycle of the device, which means is incorporated with means for fixing the ends of the contact length of tape 168 along the peripheral surface portions 178 of the arcuate members 177 to prevent the contact lengths of tape 168 from adhering to and winding around the peripheries of the cleaning rollers 154 during the cleaning cycles of the device 151.

Figure 16:
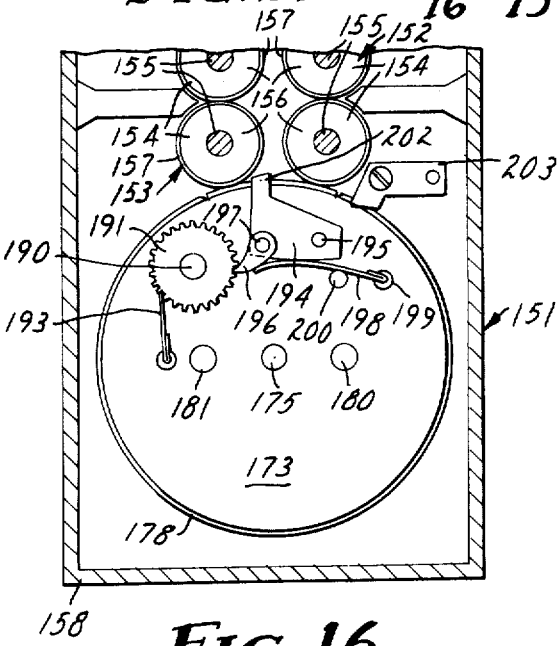
FIG. 16 is a fragmentary sectional view taken approximately along the lines 16—16 of FIG. 14.

As is seen in FIGS. 13, 14 and 16 which illustrate the drum-like member 170, in each of the drum-like members 170 and 171 a spur gear 186 is fixed to the hub 181 at its end adjacent the first end plate 173, and a pad of frictional material 187 (e.g. cork) is pressed between a circular plate on that end of the hub 180 and the first end plate 173 to restrict rotation of the hub 180. The spur gear 186 is engaged by a gear 189 fixed to a shaft 190 rotatably mounted in the first end plate 173 and having fixed to its opposite end a ratchet gear 191. The ratchet gear 191, and thereby the take-up spool 184, is prevented from rotating in a direction affording unwinding of the supply length of tape 167 by a leaf spring 193 having one end biased against the side of the adjacent tooth on the ratchet gear 191, and the other fixed to the first end plate 173. Thus, the friction material 187 and spring 193 prevent the tape from being unwound from either of the spools 183 or 184 as the contact length of tape 168 moves along the cleaning rollers 154.

A pawl assembly is mounted on the first end plate 173 of each drum-like member 170 or 171, and is adapted to engage the side of a tooth on the ratchet gear 191 and rotate the ratchet gear 191 through a predetermined angle to advance the supply length of tape 167 a predetermined distance from the supply spool 183 to the take-up spool 184 upon each rotation of the drum-like member 170 or 171 back to its disengaged position, thereby incrementally changing the contact length of tape 168 on the arcuate member 177.

Each pawl assembly includes a pivot block 194 pivotably mounted on a shaft 195 fixed to the first end plate 173 and carrying a tooth-like member 196 pivotably mounted on a shaft 197 fixed to the pivot block 194. A leaf spring 198 has one end fixed to a support 199 and extends across a support pin 200 fixed to the first end plate 173, with its opposite end biased against the tooth-like member 196 and a portion thereof between the tooth-like member 196 and the support pin 200 biased against the pivot block 194. Thus the spring 198 biases the pawl assembly to a first position with the pivot block 194 against a pin 201. During each revolution of each of the drum-like members 170 or 171, as it rotates back to its disengaged position, a projection 202 on the pivot block 194 engages a cam surface on a block 203 fixed to the frame 158, and moves the pawl assembly against the spring 198 to a second position, thereby moving the ratchet gear 191, and thereby the take-up spool 184 to advance the supply length of tape 167 onto the take-up spool 184. After the projection 202 moves past the block 203, the spring returns the pivot block 194 to its first position as the tooth-like member 196 pivots on the shaft 197 and slides along the teeth of gear 191. During such movement, the end of the leaf spring 193 is deflected by and slides along the teeth of the ratchet gear 191, and subsequently engages a new tooth to prevent subsequent reverse rotation of the take-up spool 184.

Referring now to FIGS. 17 through 21 there is shown a fourth embodiment of a device for cleaning sheets according to the present invention, generally designated by the numeral 210. Like the device 70, the device 210 is particularly adapted for cleaning lantern slides.

Like the device 70, the device 210 comprises first and second cleaning rollers, 212 and 213, respectively, rotatably mounted on a frame 214 for the device 210 in axially parallel spaced relationship, each comprising a central shaft 215, a cylindrical low durometer sleeve 216 so that the adjacent portions of the rollers will be compressed when a lantern slide is passed through the nip therebetween, and a thin outer coating 217 providing a tacky peripheral surface adapted to adhere to foreign particles on a lantern slide passed between the cleaning rollers 212 and 213 and transfer the foreign particles from the slide to the cleaning roller 212 or 213.

During a cleaning cycle of the device 210 to clean one lantern slide, the second cleaning roller 213 is rotated by a drive means (later to be explained) through a predetermined angle in one direction of rotation to drive a lantern slide 211 initially inserted by an operator in an inlet opening 218 on a block-like member 219 on the frame 214 along a path into the device 210 completely through the nip between the cleaning rollers 212 and 213 (FIG. 20) and between a pair of rotatably mounted holding rollers 220 (one of which is driven by the drive means) spaced to engage and hold the opposite surfaces on the frame of the lantern slide. The drive means then rotates the holding rollers 220 and the cleaning rollers 212 and 213 through the same predetermined angle in the opposite direction of rotation to return the lantern slide between the cleaning rollers 212 and 213 and again position it in the inlet opening 215 from whence it may be removed by the operator.

Like the device 70, the device 210 includes two roller cleaning members adapted for cleaning the cleaning rollers 212 and 213, which roller cleaning members have a greater surface tack with respect to foreign material to be removed than do the peripheral surfaces of the cleaning rollers 212 and 213, and are moved in rolling contact along the peripheries of the cleaning rollers 212 and 213 during each cleaning cycle of the device 210 to transfer to the cleaning member the foreign material removed from the lantern slide by the cleaning roller.

Figure 19:
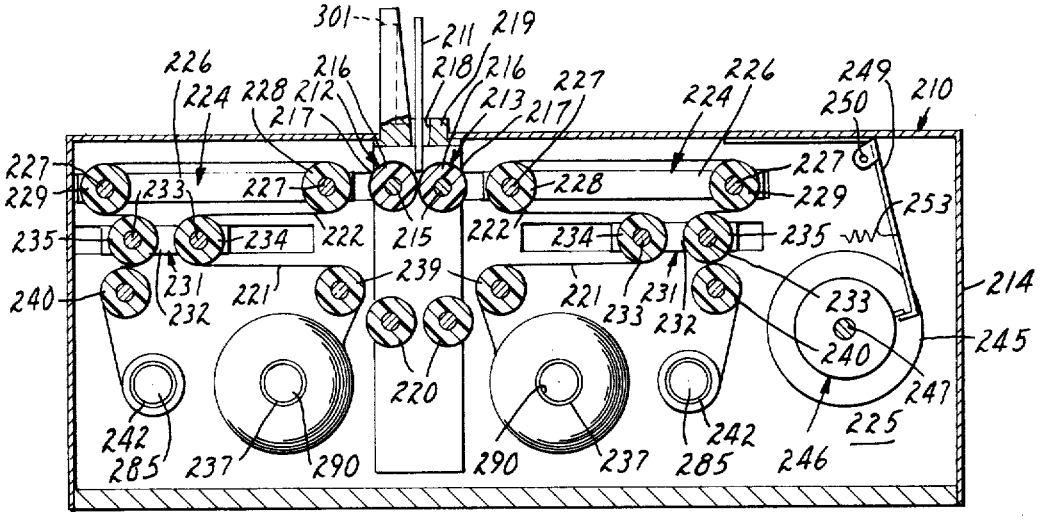
FIGS. 19 and 20 are vertical sectional views taken approximately along the lines 19—19 of FIG. 18 and sequentially illustrate a cycle of the device of FIG. 17 for cleaning a lantern slide.
Figure 20:
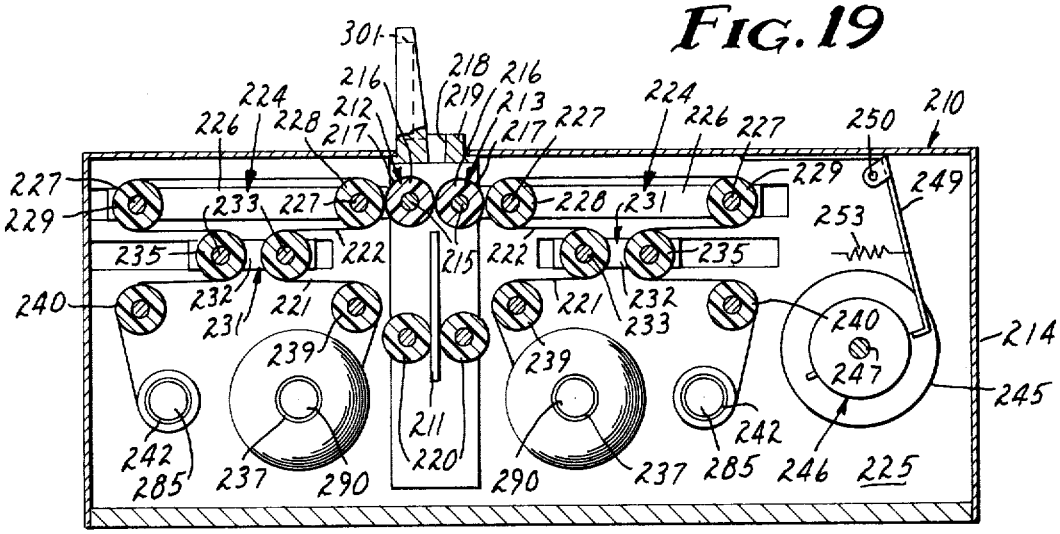
Figure 21:
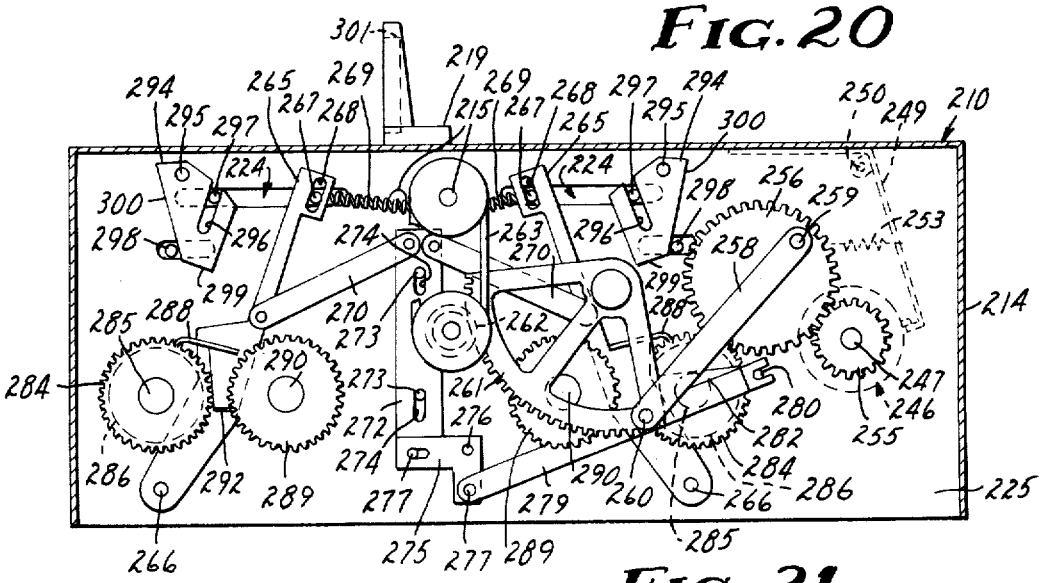
FIG. 21 is a vertical sectional view taken approximately along the lines 21—21 of FIG. 18.

Each roller cleaning member comprises a supply length of tape 221 having a width approximately the same as the coated tacky peripheral surface of the cleaning rollers 212 or 213 with which it is associated, and means for moving a contact length 222 of the supply length 221 of tape sequentially (1) from a disengaged position (FIG. 19) spaced from the cleaning rollers 212 or 213; (2) to a first engaged position with the adhesive coating on one end of the contact length 222 of the tape in generally tangential line contact with the periphery of the cleaning rollers 212 or 213 in an area spaced from the path for the lantern slides between the cleaning rollers 212 and 213; (3) longitudinally over the cleaning roller 212 or 213 (FIG. 20) with rolling contact between the cleaning roller 212 or 213 and the adhesive coating on the contact length 222 of the tape to move the line of contact therebetween from one end toward the other and for a distance at least equal to the circumference of the cleaning roller 212 or 213; and (4) back to the disengaged position (FIG. 19).

The means for moving each of the contact lengths of tape includes a first carriage 224 mounted between parallel walls 225 of the frame 214 for sliding movement in a plane parallel with the axes of the cleaning rollers 212 and 213. The first carriage 224 comprises parallel spaced bars 226 each slidably mounted in a groove in the adjacent wall 225, and two parallel shafts 227 extending between the bars 226 on which are rotatably mounted a first tape guide roller 228 adjacent the cleaning roller 212 or 213 and a spaced second tape guide roller 229. These means also include a second carriage 231 mounted between the walls 225 for sliding movement in a plane spaced from and parallel to the plane of sliding movement for the first carriage 224. The second carriage 231, like the first carriage 224, also comprises parallel spaced bars 232 each slidably mounted in a groove in the adjacent wall 225, and two parallel shafts 233 extending between the bars 232 on which are rotatably mounted third and fourth closely spaced tape guide rollers having surfaces defined by a material which restricts adhesion to the tape (e.g. "Teflon") 234 and 235 respectively, positioned with a common tangent to their peripheries adjacent the first carriage 224 also on a tangent to the adjacent peripheries of the tape guide rollers 228 and 229. The supply length of tape 221 has an unused end portion wrapped around a supply spool 237, from which it extends along a tape path around an idler roller 239 rotatably mounted on the frame, along a tape path portion parallel to the direction of movement of the second carriage 231, around and in adhesive contact with the third guide roller 234 on the second carriage 231, and around the first guide roller 228 on the first carriage 224. From there the supply length of tape 221 extends around the second guide roller 229 on the first carriage 224, around and in adhesive contact with the fourth guide roller 235 on the second carriage 231, along a path portion parallel to the direction of movement of the second carriage 231, and around a second idler roller 240 rotatably mounted on the frame 214 and has its end wound around a take-up spool 242.

When the device 210 is activated to clean a lantern slide 211, the drive means moves the first carriage 224 from a disengaged position with a portion of the contact length 222 of tape around the first guide roller 228 spaced from the adjacent cleaning roller 212 or 213, toward the adjacent cleaning roller 212 or 213 to a contact position with a portion of the contact length 222 of tape on the periphery of the first guide roller 228 pressed against the periphery of that cleaning roller 212 or 213. The ends of each supply length of tape 221 are fixed by means later to be explained at the supply and take-up spools 237 and 242, so that subsequent movement of the contact length 222 of tape over the rotating cleaning roller 212 or 213 caused by adhesive contact therewith will cause the second carriage 231 to move from a start position (FIG. 19) adjacent the second guide roller 229, toward the first guide roller 228 (FIG. 20) while the cleaning rollers 212 and 213 are driven in their first direction of rotation, and then causes the second carriage 231 to move back to its start position while the cleaning rollers 212 and 213 are driven in their second direction of rotation. Subsequently, the drive means returns the first carriage 224 to its disengaged position (FIG. 19), while a means is activated for incrementally changing the portion of each supply length of tape 221 which comprises the contact length 222 thereof during each cleaning cycle of the device 210.

The drive means for the device 210 includes a gear reduced motor 245 coupled to the input side of a single revolution clutch 246 similar to the single revolution clutch 119 in the device 70. The clutch 246 has a central output shaft 247 rotatably mounted on the frame 214 and an outer collar 248 adapted for engagement by an end of a stop arm 249 pivotably mounted on the frame 214 at a pin 250. The stop arm 249 is manually engageable through a slot 252 in the top surface of the frame 214 to move the stop arm 249 against the bias of a spring 253 from a position engaged with a projection on the collar 248 and a release position out of engagement therewith which causes the clutch 246 to engage for a single revolution of its output shaft 247 until the projection on the collar 248 is again engaged by the end of the stop arm 249 and the clutch is again disengaged. A spur gear 255 is fixed to the output shaft 247, and engages a drive gear 256 rotatably mounted on the frame 214. Upon engagement of the clutch 246 the drive gear 256 will move through a 360 degree cycle and act as a crank to drive an arm 258 pivotably mounted at pins 259 and 260 respectively between the drive gear 256 and a sector gear 261 from a start position in a first direction of rotation during the first 180 degrees of its rotation, and in the opposite direction of rotation back to its start position during the last 180° of its rotation. The sector gear 261 is in driving engagement with a spur gear 262 fixed to the shaft of one of the holding rollers 220 and via a timing belt and pulley assembly 263 also drives the second cleaning roller 213.

The mechanism in the device 210 for moving the first carriage 224 between its initial position and its engage position includes an arm 265 for each of the first carriages 224 pivoted at a shaft 266 on the frame and receiving a pin 267 extending from the first carriage 244 in a slot 268 at its end opposite the shaft 266. The arms 265 are biased toward each other (and the contact position of the first carriages 224), by a spring 269 tensioned between the arms 265. A link 270 is pivotally mounted on each arm 265 between the shaft 266 and slot 268, and the links 270 from both arms 265 are pivotably mounted on a slide 272, mounted on the frame 214 for sliding movement on a pair of spaced pins 273 received in spaced slots 274 in the slide 272 to limit movement of the slide 272 between a lower first position (FIG. 21) at which the links 270 hold the arms 265 against the bias of the spring 269 to position the first carriages 224 in their disengaged positions with the portion of the contact length 222 of tape on the first guide rollers 228 spaced from the cleaning rollers 212 and 213 (as in FIG. 19); and an upper engage position at which the links 270 are positioned to allow the spring 269 to bias the lengths of tape on the first guide rollers 228 against the cleaning rollers 212 and 213 as in FIG. 20. The slide 272 is operated by a crank arm 275 pivoted on a shaft 276 on the frame 214 and pivotally connected at pins 277 between the slide 272 and a bar 279 which has a slotted end opposite the crank 275 slidably supported on a pin 280 on the frame 214. A block 282 is attached to the bar 279 and has a surface positioned to be contacted by the adjacent end surface of the sector gear 261 when the sector gear 261 is in its start position, thereby pulling the slide 272 to its first position to separate the contact length 222 of tape from the cleaning rollers 212 and 213. Movement of the sector gear 261 away from its start position will allow the spring 269 to move the first carriages 224 and pull the tape on the guide rollers 228 into contact with the cleaning rollers 212 and 213.

The device 210 also includes means for incrementally changing the portion of each supply length of tape 221 which comprises the contact length 222 thereof during each cleaning cycle of the device 210 incorporated with the aforementioned means for fixing the ends of each of the contact lengths of tape 222 along the tape path which prevents the contact length of tape from adhering to and winding around the periphery of the cleaning rollers 212 or 213 during a cleaning cycle of the device 210.

For each supply length of tape 221 a gear 284 is attached to a shaft 285 on which the take-up spool 242 is removably fixed. A one-way clutch 286 is coupled between the shaft 285 and the frame 214 to prevent unwinding of tape from the take-up spool 242. The associated arm 265 passes behind the gear 284 and supports a projecting spring 288 having an end biased against the teeth of the gear 284 thereby providing a ratchet mechanism for incrementally winding the supply length of tape 221 on the take-up spool 242 to advance it from the supply spool 237 each time the arm 265 is pivoted to return the first carriage 224 to its disengaged position at the end of the cleaning cycle.

Also a gear 289 is fixed to a shaft 290 removably supporting the supply spool 237 for each supply length of tape 221 and is engaged by a blade 292 projecting from the adjacent arm 265 when that arm 265 is pivoted to move the associated first carriage 224 to its engaged position during a cleaning cycle of the device 210. Such engagement of the blade 292, together with the engagement of the projecting spring 288 with the gear 289 during this period fixes the ends of the supply length of tape 221 to prevent slack in the tape along the path between the spools 237 and 242.

The device 210 also includes a pair of cams 294 which insure that the second carriages 231 will completely return to their start positions at the end of the cleaning cycle. Each of the cams 294 is pivotally mounted on the frame 214 at a pin 295 adjacent one of the first carriages 224 and has a slot 296 in which is positioned a pin 297 which projects from the adjacent first carriage 224. The slot 296 is oriented so that movement of the pin 297 as the first carriage 224 moves to its engage position will rotate the cam 102 from a normal position toward the cleaning rollers 212 and 213, thereby allowing a pin 298 projecting from the adjacent second carriage 231 to move past an edge surface 299 of the cam 294 and afford reciprocal travel of the second carriage 231 during the cleaning cycle of the device 210. If the second carriage 231 does not completely return to its start position at the end of the cleaning cycle, a surface 300 of the cam 294 engages the pin 298 as the cam 294 is returned to its normal position by movement of the first carriage 224 to its disengaged position. This insures that the second carriage 231 is returned to its start position, which is important to insure that during the next cleaning cycle, the second carriage 231 can move a sufficient distance to allow movement of the entire contact length 222 of tape and prevent breakage thereof.

Also the device 210 includes means for neutralizing static electric charges on a clean lantern slide comprising a polonium alpha particle source 301 in an opening in the block 219 adjacent the inlet opening 218, identical to the source 140 in the device 70.

The device for cleaning sheets according to the present invention has now been described with reference to four embodiments, each of which is adapted for cleaning both surfaces of a sheet. It is evident that, where desired, any of these devices can be adapted to clean only one surface of a sheet by eliminating the cleaning mechanism on one side of the path for the sheet through the device, and substituting therefore a roller or other means for guiding the sheet along the path and properly biasing it against the cleaning roller or rollers on the other side of the sheet path. Additionally the means for neutralizing static electric charges on a clean sheet or lantern slide can comprise an electrically powered static eliminator.

I claim:

1. A device for cleaning foreign particles from at least one surface of a sheet, comprising:

a frame;

a cleaning roller rotatably mounted on said frame and comprising a layer of elastic, resilient polymeric material defining for the cleaning roller a cylindrical peripheral surface with a high surface tack adapted to transfer foreign particles from a said sheet to the peripheral surface of the roller upon contact and subsequent separation therebetween while affording clean separation between the sheet and the peripheral surface;

means adapted for defining a path for a said sheet past said cleaning roller with said one surface moving generally tangentially across and in rolling contact with the peripheral surface of said cleaning roller in a direction generally normal to its axis, including means adapted for biasing the sheet to slightly compress the layer of tacky material on the roller when in contact therewith, whereby foreign material on the surface of the sheet will transfer to the tacky peripheral surface of the cleaning roller;

a roller cleaning member having a contact surface with a width about the same as the width of said peripheral surface defining said sheet path, a length at least as long as the circumference of said cleaning roller, and with a greater surface tack with respect to foreign particles than said peripheral surface adapted to transfer said foreign particles from the peripheral surface of said cleaning roller to said contact surface upon contact and subsequent separation therebetween while affording clean separation between said cleaning roller and said contact surface; and means adapted for moving said contact surface longitudinally over said cleaning roller with rolling contact therebetween for a distance at least equal to the circumference of said cleaning roller to transfer foreign particles on the cleaning roller to the roller cleaning member.

2. A device according to claim 1 adapted for cleaning sheets including lantern slides, wherein said cleaning roller comprises a central rigid shaft rotatably mounted on said frame; and elastic resilient polymeric material around the shaft defining said peripheral surface, said polymeric material having a radial thickness of at least ⅛ inch and having an overall Shore A durometer value of less than 20 measured on said peripheral surface.

3. A device according to claim 1 wherein said cleaning roller comprises a central rigid shaft rotatably mounted on said frame; a cylindrical sleeve of an elastic resilient polymeric material having a Shore A durometer of less than about 20 adhered around said shaft; and a thin coating on the outer periphery of said sleeve of an elastic resilient polymeric material which defines said peripheral surface and provides said surface tack.

4. A device according to claim 3 wherein said cylindrical sleeve is polyether urethane and said thin coating is polyurea urethane elastomer.

5. A device for cleaning foreign particles from at least one surface of a sheet comprising:

a frame;

a cleaning roller rotatably mounted on said frame and comprising a layer of elastic, resilient polymeric material defining a cylindrical peripheral surface for the cleaning roller and having a high surface tack adapted to transfer foreign particles from a said sheet to the peripheral surface of the roller upon contact and subsequent separation therebetween while affording clean separation between the sheet and cleaning roller;

means adapted for defining a path for a said sheet past said cleaning roller with said one surface moving generally tangentially and in rolling contact across the periphery of said cleaning roller in a direction generally normal to its axis, and including means adapted for biasing the sheet to slightly compress the layer of tacky material on the roller when in contact therewith, whereby foreign particles on the surface of the sheet will transfer to the peripheral surface of the cleaning roller;

a roller cleaning member, comprising:

a contact length of tape having a width about the same as the peripheral surface of said cleaning roller contacted by a said sheet and a coating of pressure sensitive adhesive on one surface having a greater surface tack with respect to foreign particles than said cleaning roller adapted to transfer said foreign particles from said cleaning roller to said contact length of tape upon contact and subsequent separation therebetween, while affording clean separation between said cleaning roller and the adhesive on said contact length of tape;

means for moving said contact length of tape through a cycle sequentially:

1. from a disengaged position spaced from said cleaning roller;
2. to a first engaged position with the adhesive coating at one end of said contact length of tape contacting the cleaning roller in an area spaced from said sheet path and with the axis of the cleaning roller oriented across the width of the tape;
3. longitudinally over said cleaning roller with rolling contact between the cleaning roller and the adhesive coating on the tape for a distance at least equal to the circumference of said cleaning roller; and
4. again to said disengaged position; and means for simultaneously rotating said cleaning roller and operating said means for moving said contact length of tape through said cycle to propel a said sheet along said sheet path and transfer foreign particles removed from the surface of the sheet by the cleaning roller to the contact length of tape.

6. A device according to claim 5 wherein said device includes a supply length of pressure sensitive adhesive coated tape a portion whereof provides said contact length of tape; means for supporting the end portions of said supply length of tape extending from said contact length of tape; and means activated by the operation of said means for moving said contact length of tape through said cycle for incrementally changing the portion of said supply of tape comprising said contact length during each such cycle.

7. A device according to claim 5 adapted for cleaning sheets including lantern slides, wherein said cleaning roller comprises a central rigid shaft rotatably mounted on said frame; and elastic resilient polymeric material around the shaft defining said peripheral surface, said polymeric material having a radial thickness of at least ⅛ inch, and having an overall Shore A durometer value of less than 20 measured on said peripheral surface.

8. A device according to claim 5 wherein said cleaning roller comprises a central rigid shaft rotatably mounted on said frame; a cylindrical sleeve of an elastic resilient polymeric material having a Shore A durometer of less than about 20 adhered around said shaft; and a thin coating on the outer periphery of said sleeve of an elastic resilient polymeric material which defines said peripheral surface and provides said surface tack.

9. A device according to claim 8 wherein said cylindrical sleeve is polyether urethane and said thin coating is polyurea urethane elastomer.

10. A device according to claim 5 wherein said means for moving said contact length of tape comprises a drum-like member mounted on said frame for rotation about an axis parallel to the axis of said cleaning roller, said drum-like member comprising a peripheral surface portion which is cylindrically convex about said axis, and means for supporting said contact length of tape adhesive side out along said peripheral surface portion; and the axis of said drum-like member is spaced from the axis of said cleaning roller so that rotation of said drum-like member affords movement of said contact length of tape through said cycle from said disengaged position with said peripheral surface portion spaced from said cleaning roller, to said first engaged position when one end of said peripheral surface portion is rotated adjacent said cleaning roller and longitudinally over said cleaning roller when said surface portion is rotated adjacent said cleaning roller.

11. A device according to claim 10 wherein said means for simultaneously rotating said cleaning roller and operating said means for moving said contact length of tape rotates said cleaning roller in a single direction of rotation.

12. A device according to claim 10 wherein said means for simultaneously rotating said cleaning roller and operating said means for moving sad contact length of tape rotates said cleaning roller through a predetermined angle in one direction of rotation, and then through said predetermined angle in the opposite direction of rotation.

13. A device according to claim 5 adapted to clean both surfaces of a said sheet, wherein said means adapted for biasing the sheet to slightly compress the layer of tacky material when in contact therewith comprises a second cleaning roller on said frame having a structure and tacky peripheral surface similar to that of said first mentioned cleaning roller, and said second cleaning roller has associated therewith a second contact length of tape, means for moving said second contact length of tape through a cycle relative to said second cleaning roller equivalent to the cycle recited in claim 5, and said means for simultaneously rotating said cleaning roller and operating said means for moving said contact length of tape through said cycle rotates both of said cleaning rollers and operates both of said means for moving said contact lengths of tape through said cycles to propel a said sheet along said sheet path and transfer foreign particles removed from both surfaces of the sheet by the cleaning rollers to the contact lengths of tape.

14. A device according to claim 6 wherein said means for moving said contact length of tape through said cycle comprises:

first and second guide rollers;

a first carriage rotatably supporting said first and second guide rollers spaced by a distance at least equal to one half the length of said contact length of tape in axially parallel opposed relationship with said rollers supporting a portion of said supply length of tape extending therebetween and around opposite peripheral surface portions thereof for about a 180° wrap with its adhesive coated surface opposite said rollers, said first carriage being mounted on said frame for movement between a first position with the tape around said first guide roller spaced from said cleaning roller to provide said disengaged position for said contact length of tape, and a second position with the tape extending around said first roller contacting said cleaning roller to provide said first engaged position and said rolling contact between said contact length of tape and said cleaning roller;

third and fourth guide rollers; and a second carriage rotatably supporting said third and fourth guide rollers in axially parallel closely spaced relationship with a plane tangent on the peripheries of said third and fourth guide rollers on one side being tangent to the peripheries of said first and second guide rollers on their sides opposite the portion of said supply length of tape extending therebetween, the end portions of said supply length of tape extending from said first and second guide rollers along a path in said plane and about 180° around the adjacent one of said third and fourth guide rollers in adhesive contact therewith and away from said third and fourth guide rollers along a path approximately tangent to the peripheries of said third and fourth guide rollers opposite said first carriage, the ends of said supply length of tape being fixed on said frame and said second carriage being mounted on said frame for movement with the peripheries of said third and fourth guide rollers generally in said planes for movement between a first position adjacent said second guide roller and a second position adjacent said first guide roller to afford movement of said contact length of tape longitudinally over said cleaning roller.

15. A method for cleaning foreign particles from at least one surface of a sheet comprising the steps of:

providing a rotatably mounted cleaning roller comprising a layer of elastic, resilient polymeric material defining for the cleaning roller a cylindrical peripheral surface with a high surface tack adapted to transfer foreign particles from a said sheet to the peripheral surface of the roller upon contact and subsequent separation therebetween, while affording clean separation between the sheet and the peripheral surface;

moving the sheet past the cleaning roller with said one surface moving generally tangentially across and in rolling contact with the peripheral surface of the cleaning roller in a direction generally normal to its axis;

pressing the sheet against the cleaning roller to compress the layer of tacky material on the roller during said moving step, whereby foreign material on the surface of the sheet will transfer to the tacky peripheral surface of the cleaning roller upon separation thereof;

providing a roller cleaning member having a contact surface with a width about the same as the width of the peripheral surface defining the sheet path, a length at least as long as the circumference of the cleaning roller, and with a greater surface tack with respect to foreign particles than the peripheral surface adapted to transfer foreign particles from the peripheral surface of the cleaning roller to the contact surface upon contact and subsequent separation therebetween while affording clean separation between the cleaning roller and the contact surface; and moving the contact surface longitudinally over the peripheral surface of the cleaning roller with rolling contact therebetween for a distance at least equal to the circumference of the cleaning roller to transfer foreign particles on the cleaning roller to the roller cleaning member.

16. A method according to claim 15 wherein said step of moving the contact surface is performed during the step of moving the sheet.

17. A method according to claim 15 wherein said step of moving the contact surface comprises the sequential steps of:

moving said roller cleaning member from a disengaged position spaced from said cleaning roller to a first engaged position with one end of said contact surface contacting the cleaning roller and the axis of the cleaning roller oriented across the width of the contact surface;

propelling the contact surface longitudinally over the cleaning roller with rolling contact therebetween for a distance at least equal to the circumference of the cleaning roller; and returning the roll cleaning member to the disengaged position.

* * * * *